United States Patent [19]

Liller

[11] 4,224,143

[45] Sep. 23, 1980

[54] CONSTRUCTION OF SHALLOW DISH WITH TAPERED ORIFICE FOR STREAMLINED FLOW CYCLONE WASHING OF CRUSHED COAL

[76] Inventor: Delbert I. Liller, P.O. Box 64, Deer Park, Md. 22150

[21] Appl. No.: 2,731

[22] Filed: Jan. 11, 1979

[51] Int. Cl.[3] ..... B04C 5/14

[52] U.S. Cl. ..... 209/211; 209/144; 210/512 R

[58] Field of Search ..... 209/144, 211; 210/512 R, 84, 232; 432/264; 220/327, 328; 55/434, 328

[56] References Cited

U.S. PATENT DOCUMENTS

| | | | |
|---|---|---|---|
| Re. 26,720 | 11/1969 | Visman | 209/211 |
| 3,087,645 | 4/1963 | Eddy | 209/211 X |
| 3,136,723 | 6/1964 | Edwin | 210/512 R |
| 3,800,946 | 4/1974 | Reid | 210/512 R X |
| 3,887,456 | 6/1975 | Loughner | 209/211 |
| 3,897,609 | 8/1975 | Schmidt | 220/327 X |
| 3,902,601 | 9/1975 | Turnleg | 209/211 X |
| 3,923,210 | 12/1975 | Alexander | 210/512 R X |
| 4,090,956 | 5/1978 | Benzon | 210/512 R X |

OTHER PUBLICATIONS

Translation from Chemie-Engenieur Technik 30, 1958: 85-95, Trawinski-Approximate Formulations for Calculations of Important Operating Data for Hydrocyclones & Centrifuges, pp. 7, 8.

*Primary Examiner*—Robert Halper
*Attorney, Agent, or Firm*—Abraham A. Saffitz

[57] ABSTRACT

A replaceable shallow bottom dish assembly of novel geometry and critical settings which are fixed for the vortex finder and orifice outlet to establish washing efficiency, quality and recovery for ash and inorganic sulfur removal in the water washing of coal. Some operating linear adjustments are the fixed settings of the dish curvature at the throat, the dish depth or height and the distance between the bottom of the vortex finder and the top of the dish. These critical adjustments are best expressed as a fraction of the cyclone inside diameter. The replaceable shallow dish is abrasion resistant and includes an orifice unit supported by a plate bolted to the lower end of the cyclone and designed to be lowered and pivoted away from the cyclone so as to enable easy access into the cyclone for adjustment and repair.

Additionally, there is described a method of rebuilding the bottom sections of existing cyclones in an abrasion resistant form which increases cyclone service life and maintains high efficiency of separation.

16 Claims, 18 Drawing Figures

LEGEND

| ZONE | SOLID DENSITY |
|---|---|
| 1 | LIGHTEST |
| 2 | LIGHTER |
| 3 | LIGHT |
| 4 | HEAVIER |
| 5 | HEAVIEST |

LEGEND

| ZONE | SOLID DENSITY |
|---|---|
| 1 | LIGHTEST |
| 2 | LIGHTER |
| 3 | LIGHT |
| 4 | HEAVIER |
| 5 | HEAVIEST |

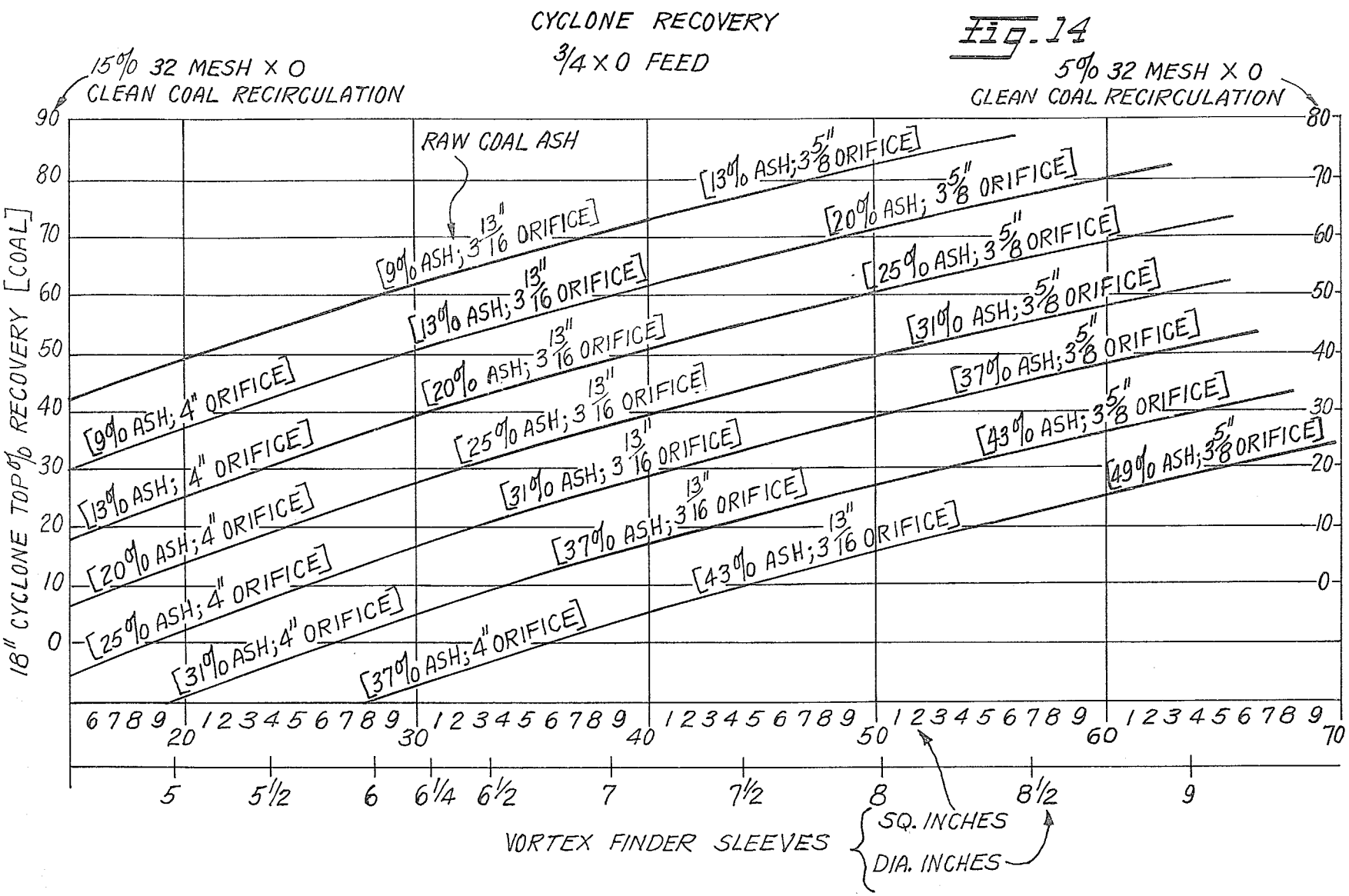
FIG. 14
CYCLONE RECOVERY
3/4 × 0 FEED
15% 32 MESH × 0
CLEAN COAL RECIRCULATION
5% 32 MESH × 0
CLEAN COAL RECIRCULATION
RAW COAL ASH
[9% ASH; 4" ORIFICE]
[13% ASH; 4" ORIFICE]
[20% ASH; 4" ORIFICE]
[25% ASH; 4" ORIFICE]
[31% ASH; 4" ORIFICE]
[37% ASH; 4" ORIFICE]
[9% ASH; 13/16" ORIFICE]
[13% ASH; 13/16" ORIFICE]
[20% ASH; 13/16" ORIFICE]
[25% ASH; 13/16" ORIFICE]
[31% ASH; 13/16" ORIFICE]
[37% ASH; 13/16" ORIFICE]
[43% ASH; 13/16" ORIFICE]
[13% ASH; 5/8" ORIFICE]
[20% ASH; 5/8" ORIFICE]
[25% ASH; 5/8" ORIFICE]
[31% ASH; 5/8" ORIFICE]
[37% ASH; 5/8" ORIFICE]
[43% ASH; 5/8" ORIFICE]
[49% ASH; 5/8" ORIFICE]
18" CYCLONE TOP% RECOVERY [COAL]
VORTEX FINDER SLEEVES
SQ. INCHES
DIA. INCHES

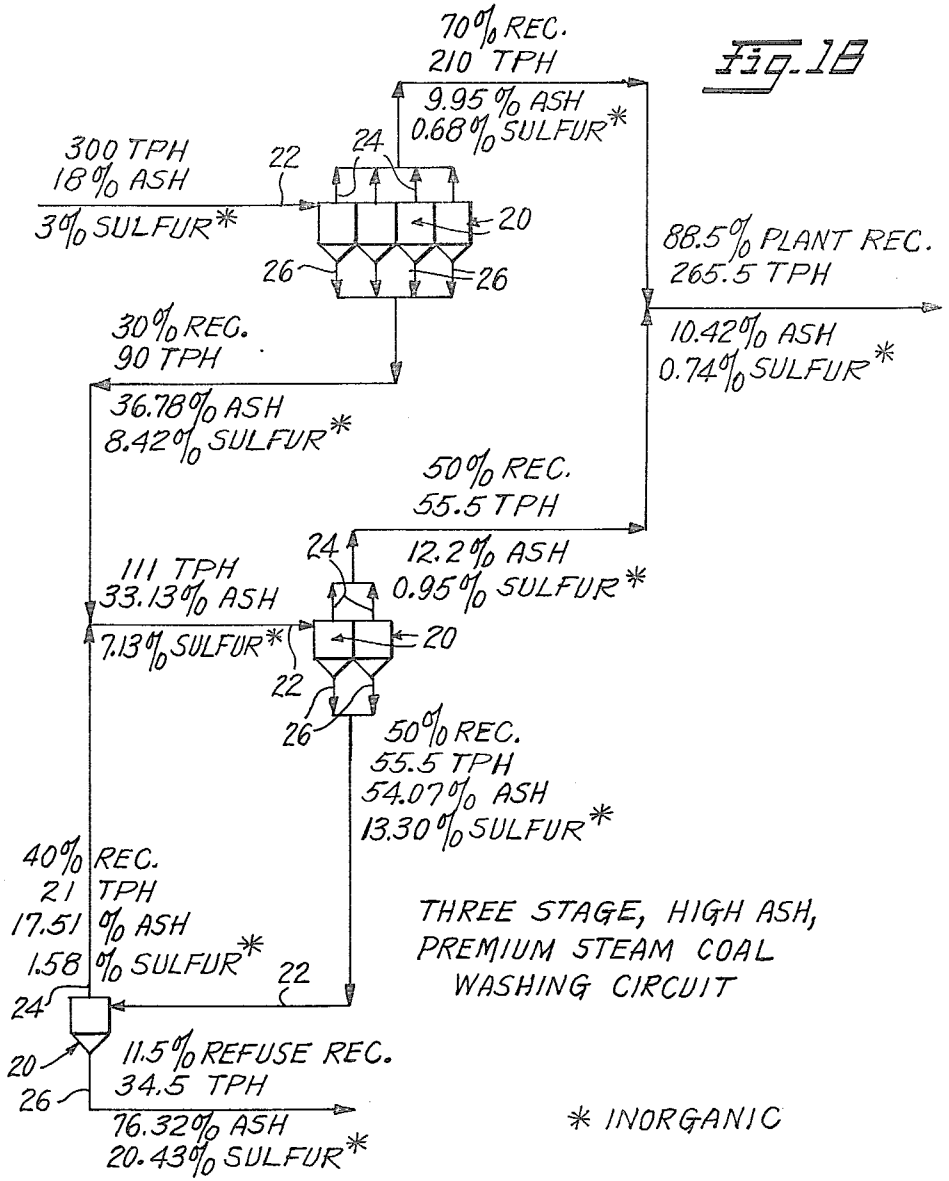
FIG. 18
300 TPH
18% ASH
3% SULFUR*
70% REC.
210 TPH
9.95% ASH
0.68% SULFUR*
88.5% PLANT REC.
265.5 TPH
10.42% ASH
0.74% SULFUR*
30% REC.
90 TPH
36.78% ASH
8.42% SULFUR*
50% REC.
55.5 TPH
12.2% ASH
0.95% SULFUR*
111 TPH
33.13% ASH
7.13% SULFUR*
50% REC.
55.5 TPH
54.07% ASH
13.30% SULFUR*
40% REC.
21 TPH
17.51% ASH
1.58% SULFUR*
11.5% REFUSE REC.
34.5 TPH
76.32% ASH
20.43% SULFUR*
THREE STAGE, HIGH ASH, PREMIUM STEAM COAL WASHING CIRCUIT
* INORGANIC
20
22
24
26

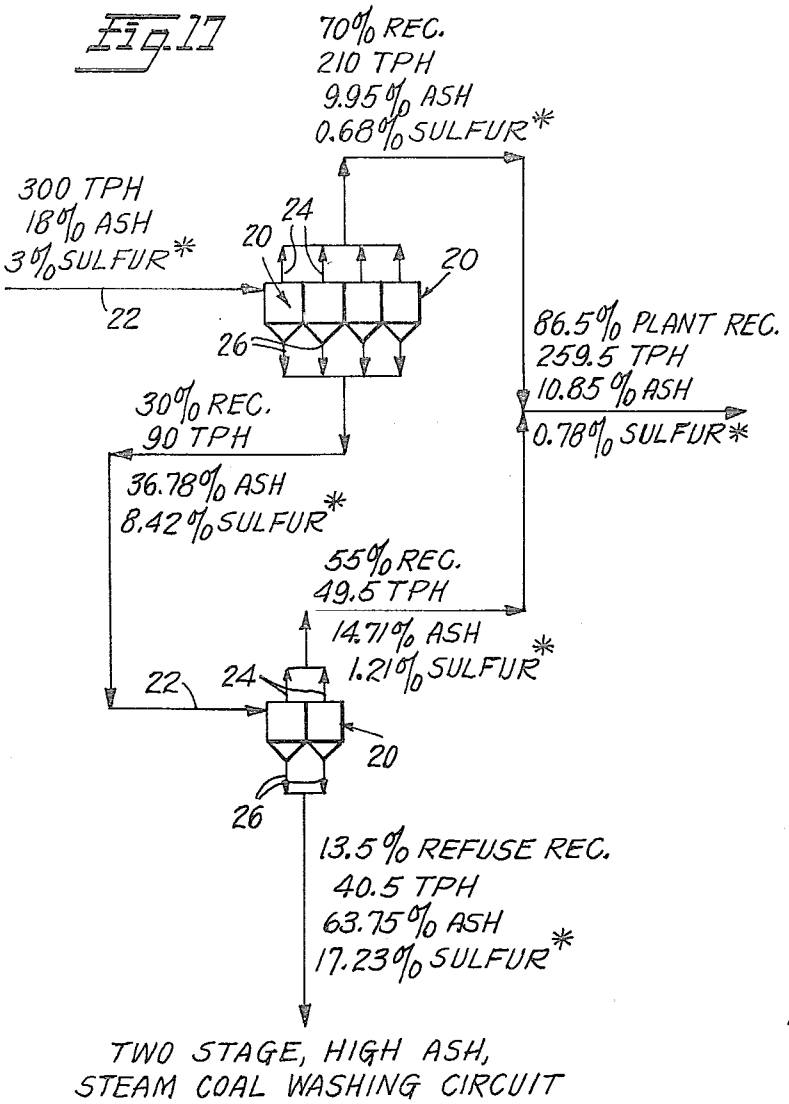
FIG. 17
300 TPH
18% ASH
3% SULFUR*
70% REC.
210 TPH
9.95% ASH
0.68% SULFUR*
86.5% PLANT REC.
259.5 TPH
10.85% ASH
0.78% SULFUR*
30% REC.
90 TPH
36.78% ASH
8.42% SULFUR*
55% REC.
49.5 TPH
14.71% ASH
1.21% SULFUR*
13.5% REFUSE REC.
40.5 TPH
63.75% ASH
17.23% SULFUR*
TWO STAGE, HIGH ASH, STEAM COAL WASHING CIRCUIT
20
22
24
26

CONSTRUCTION OF SHALLOW DISH WITH TAPERED ORIFICE FOR STREAMLINED FLOW CYCLONE WASHING OF CRUSHED COAL

CROSS REFERENCE TO RELATED APPLICATIONS

| CROSS REFERENCE TO RELATED APPLICATIONS | |
|---|---|
| Case No. | Title |
| 1 | Inlet Line Deflector And Equalizer Means For A Centrifugal Cyclone Used For Washing And Method of Washing Using Deflectors And Equalizers; Serial No. 860,330, filed December 14, 1977 |
| 2 | Method And Apparatus For Testing And Separating Minerals, Serial No. 860,331 now U.S. Pat. No. 4,157,925, filed December 14, 1977 |

BACKGROUND OF THE INVENTION

1. Field of the Invention

This invention lies in the field of washing coal with water only in a shallow bottomed centrifugal separating cyclone of circular cross-section having a cylindrical portion with a diameter to height ratio of 0.8 to 1.3, preferably 0.90 to 0.95, the cyclone fitted with a single inlet pipe, a shallow dish below the cylindrical portion, a single bottom orifice fitted to the shallow dish and a fixed vortex finder leading to an outlet at the top for removal of washed coal. Gravity separation under streamlined flow is accomplished with light coal particles at a gravity value down to about 1.3 using crushed coal ranging in size from $1\frac{3}{4}'' \times 0$ down to $\frac{3}{8}'' \times 0$.

The invention also lies in the field of providing an easily insertable abrasion resistant bottom dish having unique toughness and wear resistance characteristics to provide trouble-free, efficient coal washing based on the special material characteristics and the critical geometry of the shallow bottom dish which adapts it to fit in a closely contoured relationship to the cylindrical portion of the cyclone.

Further, the invention lies in the field of rebuilding cyclones to include the insertable dish and orifice and set the critical adjustments of the invention.

The invention also lies in the field of cleaning ores other than coal to rid them of impurities by taking advantage of the newly discovered efficiency and capacity taught in the present application.

In particular, the field of the invention is that of my Case No. 1, Ser. No. 860,330, filed Dec. 14, 1877, but added to Case No. 1 teachings are the empirically determined critical values above identified to extend the use of the invention to greater efficiency and economy to meet the operating requirements for cleaning of any commercially producible coal with water only and to reduce its non-combustible ingredients prior to using the coal in a utility or steel plant, in a pipeline for transportation or for industrial or home heating.

The invention also deals with ecology in washing raw coal to get clean coal while removing refuse, this eliminating cancer causing materials and other pollutants. Similarly, cancer causing asbestos is removed from taconite. Cancer inducing fly ash by the test for "bacteria mutation" is removed from the coal before burning.

COMMERCIAL CYCLONES

The least expensive way to deal directly with the impurities that pollute the environment is to remove them in a water washing centrifugal cyclone machine, such as a hydrocyclone. In 1977 there were 177 coal companies using hydrocyclones, as listed in the *Keystone Coal Industry Manual.* The basic cyclone design has not changed in many years and, apart from the invention in Case No. 1 for streamlined flow in a short space by turning the material twice around before entering the cyclone dish zone, there has been no major change in the prior art.

ENERGY POLICY FOR SWITCHING FROM OIL TO COAL

Since the energy requirement for pollution control is mandatory for all utilities burning coal to generate electrical power, it is obvious that any efficient system to remove mineral ash and sulfur from coal will benefit the public, save money and minimize respiratory risk from steam generating plants, see *Fortune,* Nov. 20, 1978, pages 50 through 60. It is equally obvious that removal of inorganic sulfur from the coal by efficient washing will save substantial maintenance costs for expensive pollution control equipment which the utilities are now required to install. Accordingly, serious attention is merited for preparing freshly mined coal prior to using it. It is elementary good sense to wash coal and remove likely respiratory disease-causing chemicals, e.g., $SO_2$ and fly ash, rather than to burn dirt at a steel plant or utility. Preparation costs are rising, mainly due to the increased costs for large capital outlays for jigging equipment.

DESCRIPTION OF THE PRIOR ART

Copending Application, Ser. No. 860,330, filed Dec. 14, 1978:

My copending application, Case No. 1, Ser. No. 860,330, filed Dec. 14, 1977, is incorporated herein by reference and teaches creating directed streamlined flow by direction incoming high solids concentrations of crushed coal in water tangentially along the wall of the bowl of a shallow bottomed cyclone while diverging two streams, namely the incoming inlet coal slurry stream and the swirling coal slurry stream, in the cyclone. As a result, the essential preliminary condition of streamlined flow is created. This flow must occur in the centrifugal cyclone in order to accomplish efficient and high capacity washing of coal or other ores separate impurities having a different gravity than the cleaned material.

2. Prior literature on Operation of Centrifugal Separating Cyclones:

*Chemical Engineers' Handbook* by Robert H. Perry and Cecil H. Chilton, published by McGraw-Hill Book Company, at pages 21 through 57 describes the operating conditions for the separating cyclone water washing of coal, namely inlet pressure of about 10 to 14 pounds per square inch gauge pressure for a 20 to 24 inch cyclone, which is the commonly used cyclone size in coal washing plants. The lower limit below which recovery of low gravity coal cannot be achieved is about 6 to 8 pounds per square inch gauge pressure. Finer sizes of crushed coal are separated at slightly higher pressures but pressures above 14 pounds per square inch are not recommended because of accelerated wear. Residence time is very short. The cyclone shown in the Handbook has a long cone and a large volume is circulated for each ton of feed treated in the cone. This results in high energy consumption, low tonnage recovery based on water used and high equipment cost.

Coal Processing Equipment of Uniontown, Pennsylvania describes a Var-A-Wall coal washing plant in the brochure entitled "Hydronomic Modular, Multimedia Coal Washer". The Coal Processing Equipment plant is designed to provide an outside adjustable wall to increase the height of the cyclone. The dominant feature is jigging with washing done under low water pressure. The extension of the cylinder wall length and volume and a variable depth adjustment of the vortex finder tube create a higher energy loss in a longer cyclone with greater water requirements.

*The Keystone Coal Industry Manual,* Copyright 1977, McGraw-Hill, Inc., is a directory of mechanical coal cleaning plants which describes the name, location, daily capacity, type of cleaning and plant design. The directory identifies 175 plants within the continental United States and 2 plants in Canada which use low pressure jigging cyclones for coal washing at low solids. Most of these jigging cyclones are heavy media plants utilizing a magnetite suspension. Substantially all heavy media cyclones operate at a recommended 10 to 12 pounds per square inch pressure. Present recommendations to coal plant operators is to utilize jigging action and steeper cones so that the pressure drops in the cone substantially to atmospheric pressure at the refuse outlet.

The article "Preparation Treads" published in *World Coal,* March 1978, page 13, gives the basic performance data for a heavy media jigging cyclone (24 inch). The crushed coal feed is $\frac{3}{8}''\times 0$ which is separated in three fractions, e.g., $\frac{3}{8}''\times 28$ mesh, 28 mesh $\times 100$ mesh and 100 mesh $\times 0$. These plants operate at a 1.76 density separation. Magnetite losses are about 1 kilogram per ton of coal washed. The objective is for a separation as low as 1.40 relative density.

The Jan. 1, 1978 issue of *Coal Age,* pages 65 through 84, provides a portfolio of flow sheets for the washing plant at the American Electric Power Mine, Helper Site, Salt Lake City, Utah using heavy media cyclones and special water conservation methods. A similar heavy media plant is shown of the Roberts and Schaefer design with a production rate of 1,750 tons per hour. A third heavy media plant from McNally-Pittsburgh is shown for the Jefferson County Mine in Alabama. Still another heavy media Heyl and Patterson cyclone plant is shown which is designed for existing 650 Mw generating units. Yet another preparation plant is shown in Mingo County, West Virginia. All of these use heavy media and all are in the multi-million dollar category. In contrast, the capital investment in the present retrofitted cyclone is a small fraction of these costs. To illustrate, the McNally-Pittsburgh plant at Wilson, Maryland invested 96 million dollars to process 1,000 tons per hour by jigging while the two stage plant of the invention invests slightly less than 1 million dollars to process 150 tons per hour by streamlined centrifugal separation. At the same output, the jigging choice costs 15 times as much as the centrifugal separation of the invention.

As reported in The New York Times on Feb. 10, 1978, the Coal Policy Project which was organized in 1976 under the sponsorship of the Center for Strategic and International Studies at Georgetown University, Washington, D. C. has brought agreement on more than 200 steps to help the nation switch from oil to coal in ways that are economically sound and environmentally tolerable. One main recommendation was that producible coal. e.g., coal which is more than 50% coal content and less than 50% impurity (United States Geological Survey definition), should be mined in those parts of the country where the product will have the highest heat content. Further, agreement was reached that Eastern coal is more efficient and cleaner, in terms of pollution, than Western coal. Deep underground mining in Southern Illinois, Indiana and the Application states was recommended. Strip mining was thought best confined to only thick seams in Wyoming. All parties agreed that cost of electrical energy should be kept down, research on removing dirt should be stepped up, transportation should be improved and washing technology encouraged.

3. Prior Art in The United States Patent Office a. Water Only Coal Washing Operations Fitch, U.S. Pat. No. 2,981,413, dated Apr. 1961, proposed the use of a vortex finder as a classifier means in a large capacity cyclone for the separation of fine from coarse particles in a process of separating solids in liquid suspension.

Visman, U.S. Pat. Reissue No. 26,720, dated Nov. 1969, was the first to realize success in keeping size separation, as in Fitch, to a minimum while achieving gravity separation using finely crushed coals. Visman's examples are all at $\frac{1}{4}''\times 0$ at low pulp solids at about 10% in contrast to 10% to 35% of solids herein. Visman's object was to achieve a jigging action along a horizontal section of his uniquely designed cyclone to separate fine particles from coarse particles in contrast to centrifugal separation herein. Both Visman and Fitch first created turbulence by jigging and then tried to control turbulence at the separation zone where the light particles were removed from the heavy particles. In contrast, the invention herein described avoids turbulence.

Loughner, U.S. Pat. No. 3,887,456, dated June 1975, discloses a shallow bottomed separating cyclone in which controlled turbulence by jigging is introduced into the bowl by riffler means. In Loughner, rifflers are provided to gently open a bed of heavier particles and release lighter particles, thereby permitting the lighter particles to be displaced and more centrally aligned for more complete separation.

Samson et al, U.S. Pat. No. 2,377,524, dated June 1945, is cited by Fitch in his U.S. Pat. No. 2,981,413 as an early example of an unobstructed freely whirling liquid in the interior of the casing having an axis of radial symmetry, the casing fitted with a vortex finder for clean particles at the top and an orifice at the bottom through which the heavy particles of grit and sand are removed. Samson emphasized the high velocity of 25 feet per second which sets up centrifugal separating forces to push heavy particles against the wall of the cone creating a vortical whirl which causes an upward stream of lights at the center of the cone. Both Fitch and Samson teach a long cone dimension, in Samson 5 to 15 times the diameter of the cylindrical portion, leading one away from the shallow dish concept of the present invention.

In contrast, Visman and Loughner teach a shallow cone in which the cone height is far less than the diameter of the cylindrical portion and in which the orifice structure has either no taper (purely cylindrical) or only a slight taper, but each seeks turbulence by gentle jigging at the bottom.

Only Fitch and Samson are high velocity operations, e.g., about 25 feet per second, which is between 310 and 320 rpm, while Loughner and Visman are low velocity operations, e.g., less than half the velocity of Fitch and Samson.

Dehne, U.S. Pat. No. 3,802,570, dated Apr. 1974, is cited to show a special type of orifice construction to prevent reentrainment of heavy particles into the cleaned particles stream at the center of the swirling vortex. Dehne teaches that the major serious problem with efficiency caused by reentrainment occurs in the region of the exit from the conical housing out of the lower orifice of the discharge outlet. A special construction for stabilization is provided of steel or corrosion resistant material for the ascending stream.

b. Erosion Resistant Separable Dishes In The Form Of Linings Or Moldings

Hirsch, U.S. Pat. No. 2,975,896, dated Mar. 1961, describes the basic construction of a three piece cyclone, e.g., a top cylindrical portion bolted to an intermediate conical portion which is in turn bolted to a bottom tapered orifice portion. Hirsch recognized that the tapered dish constituting the intermediate portion and the orifice portion would wear faster, necessitating replacement of the worn part.

Eddy et al, U.S. Pat. No. 3,087,896, dated April 1963, emphasized the abrasion resistant lining material provided in the easily erodible parts, namely the cone and orifice, and suggested coating of tungsten carbide and alumina as examples of material for lining steel.

Erwin et al, U.S. Pat. No. 3,136,723, dated June 1964, is similar to Eddy but uses an apertured plate to support the cone bolted to the cylindrical portion.

Other linings, much softer than tungsten carbide, have been suggested for the easily erodible conical parts and orifice structures, e.g., cured urethane rubber which is cast onto the fabricated steel cone in Feasel, U.S. Pat. No. 3,499,531, dated March 1970. The rubbers are less desirable than ceramic but more desirable than steel.

Townley, U.S. Pat. No. 3,902,601, dated Sept. 1975, improved these abrasion resistant properties of the cyclone cone with a one piece molded polyurethane rubber cone combined with an orifice to bolt onto a urethane lined cylindrical portion, e.g., a two piece cyclone without the use of any plate supports.

c. Visman Geometry Versus Liller Geometry

The Visman angle of 135° compared to about 35° for Liller's first included angle in the dish causes too fast an expansion on the helical path of the swirling slurry, not allowing sufficient time for the first layer directing force to be applied to the different specific gravity particles. The large angle causes a high degree of remixing of the high specific gravity particles with the low specific gravity particles via turbulence.

Visman goes from a B" diameter to a 0.424B" diameter in 0.111B" of verticle height compared to Liller going from a B" diameter to 0.417B" diameter in 0.236B" of vertical height. Visman's bottom is a low centrifugal force turbulent flow jigging bottom. Liller's bottom is a high centrifugal force streamlined flow smooth bottom. The flow path turn is much too fast in Visman.

The turbulence created when using Visman's bottom in a high centrifugal force, high flow cyclone would destroy all laminar flow created, thus completely breaking down the centrifugal particle separating zone by specific gravity which results in a very poor quality clean coal. Separating efficiency is lost under turbulence.

Visman's bottom is very similar to Loughner's bottom, going from a straight wall to a very flat surface in a short vertical distance.

It is noted that FIG. 3 on sheet 1 of Visman's patent does not agree with FIG. 1 on the same sheet, thus indicating that a different scale was used.

From my experience in the plant with recovery, in Visman's FIG. 1 geometry the recoveries obtained were in the range of 70% to 95%. By changing the geometry to that of FIG. 3, the recoveries are lowered by approximately 50%.

Using either of the above Figs. produces a very low efficiency separation process compared to streamlined, high flow, high centrifugal force cyclone operation.

Visman

1. Operates under back pressure;
2. Lower end of vortex finder is located a predetermined distance between the first and second conical portions; drawing shows location at top of dish section;
3. Conical frustrum (included angle faces) of increasing inclination toward the open aperature:
   a. First conical angle frustrum greater than 100° and of the order of 135°;
   b. Second conical frustrum of the order of 75°;
   c. Third conical frustrum of the order of 20°;
4. Separation:
   a. Coarse particles separate in conical section 19;
   b. Middlings separate in conical section 20;
   c. Fines separate in conical section 21.

d. Critical Wear and Geometry

Day, U.S. Pat. No. 4,053,393, states at column 1, lines 50 through 57, that the main problem of a replaceable rubber or ceramic liner or composite abrasion resistant liner is the wearing at the smaller diameter parts. Day acknowledges that others, such as Erwin et al and Gilbert, have partly overcome the problem by combining ceramic with molded rubber parts to put the ceramic in the greatest zone of wear but that this requires a fit between rubber and ceramic parts to prevent leakage and interference with proper flow, which is essential in producing the separation of lighter particles from heavier particles.

Criner, U.S. Pat No. 2,622,735, and Townley, U.S. Pat. No. 3,902,601, were found by Day to e inadquate because of small part movement in the downward direction even though movement in the upward direction was prevented by the shoulder in the shell.

Samson, U.S. Pat. No. 2,377,524, teaches continuously separating solid material, such as grit or sand which is heavier than the product pulp which is being continuously recovered, at a pulp flow of 18 gallons per minute in a whirling motion at 0.5% pulp solids content. The cyclone has a very short cylindrical section (2" to 4") and a long conical portion, with a cylindrical portion of about 33" in length in axial alignment to the outlet. The bottom of the cone has a diameter of $\frac{1}{8}$ to $\frac{1}{4}$ of the cylindrical portion. Samson emphasized that the interior of the cyclone must be smooth and absolutely free of any rough projection that would cause turbulence or flow retardation, e.g., at sharp corners or abrupt curvature changes.

Samson also stressed that a high velocity of 25 feet per second created a vortex or vortical whirl and set up a centrifugal force that would separate particles that are slightly higher in gravity than the pulp and forced the heavy particles out against the wall of the cone while the light pulp particles, which are affected less by centrifugal action, stayed at the inside. Simultaneously, the vortical whirl caused an upward whirling moving stream at the center of the chamber lying within the downwardly moving whirling stream.

The long cone dimension, 5 or 15 times the cylindrical dimenson, which Samson stressed created a removal zone in the cone and precluded any friction creating projections to attain the removal of 97% of the dirt in the downward continuously exiting stream and the recovery of the washed pulp in the continuously drawn upward stream. To treat 5 parts of pulp on a dry basis, 995 parts of water is required in Samson at a feed intake of 18 gallons per minute, which corresponds to 25 feet per second.

It would be expected that, if 995 parts of water can remove 97% of the dirt associated with 0.5% solids in a deep cone cyclone, then a lesser ash removal would be achieved with a shallow cylindrical portion and a shorter conical section relative to the height of the cylindrical portion.

Thus, if 800 parts of water and 200 parts of solids were used, as in the invention, a 400 fold increase of solids, one would expect possible half of the mineral ash, sand and grit removal as in Samson.

The soft and flexible material making up the small liner part in Criner and Townley causes intolerable independent movement of the lower end of the liner part and thereby interrupts the smooth surface over which flow takes place. See lines 6 through 26 in Day.

The following discoveries concerning erosion of the small lining parts in Day et al, U.S. Pat. No. 4,053,393, have been made after washing hundreds of thousands of tons of coal:

1. Parting line between the small liner part (orifice) and the large liner part (dish) changes the flow pattern at the parting line and accelerates wear in both directions, up and down;
2. Dimensions of thickness worn away may be controlled within a specific geometric curved pattern in both zones, one upstream and one downstream of the parting line;
3. This control of the zone is based only on the compound curvature of the larger part (dish), the compound curvature of the smaller part (orifice) and a smooth uninterrupted unique compound curvature between upper and lower parts.

In each of the above three discoveries, the interior surface of the dish blended smoothly with the interior surface of the cylindrical portion of the cyclone in which the inlet was fitted. In contrast to the cemented dish construction of jigging cyclones, such as described in Loughner, U.S. Pat. No. 3,887,456, dated June 1975, the one piece dish-orifice unit of the present invention is not cemented.

In order to apply these discoveries in practical engineering terms, it was found that all dimensions of the cyclone, vortex finder and dish must be expressed in terms of the cyclone bowl inside diameter B whereby the results determined for one size cyclone diameter can be accurately predicted for another size, e.g., in diameter changing from an 18" to a 20" diameter or to a 14" diameter of B. These cyclone dimensions are shown in Table A herein.

4. Commercial Water Only Jigging Cyclones for Separating Low Grade Coal From Refuse (See Loughner U.S. Pat. No. 3,887,456 a. Operating Velocities and Pressures

Water only jigging cyclones are the most recent centrifugal machines used to recover usable low grade steam coal from gob or refuse in the usual cleaning plants or at the mine.

The jigging cyclones are adjusted to process high mineral ash raw product having values of 30 to 50% mineral ash.

The feed varies from 20 to 50 TPH of raw coal requiring a pumping capacity from 600 to 1900 GPM of coal water slurry. These feed rates permit either low or high cyclone pressures and fluid velocities, e.g., pressures from 8 to 25 psi and fluid velocities from 10 to 22 feet per second.

However, the operator adjusts the velocity and pressure to maximize the percent recovery (the amount of product reporting out through the vortex finder being preferably 70% of the inlet feed entering the cyclone. Adjustment is made by changing the vortex finder depth and the diameter of the apex in the refuse outlet.

By further trial and error, one can further adjust the recovery for better quality of product. Since jigging cyclones require turbulence while centrifugal separating cyclones have impaired efficiency under turbulence. Hence, an optimum operating efficiency value is different for each type of cyclone and each has very different optimum capacity.

Since the efficiency values for the jigging cyclone depends upon the relative amount of mineral ash, pyritic sulphur, and other impurities, it is usually preferred to go to lower velocities and by combining jigs, float-sink tanks, and other separating devices, the design engineer can plan for as many separating stages as are necessary to obtain the optimum recovery and coal quality as predicted by a laboratory float sink test of the raw coal sample, whether it be taken from a refuse pile, strip coal, deep mined coal, hard coal, soft coal, crop coal, or fully developed nonoxidized coal.

Although the jigging cyclone worked well on raw coals that could be washed for separation at 1.65 gravity and above, it soon became evident that separation below 1.65 gravity could not be achieved and only low quality steam coal was recovered. Typical results in the jigging cyclone were as follows:

Raw coal feed rate—20 to 50 TPH
% solids—5% to 12%
% recovery—25 to 40% (Refuse thrown away 60% to 75%) Best Quality Product—low quality steam coal

5. Unsuccessful Experiments with Jigging Cyclones a. Settings of Jigging Cyclone

At settings of jigging cyclone of 1.65 and above, the first changes tried were to lower the specific gravity by means of greater constant pumping pressure including the following steps of adjustment; raise vortex finder and widen orifice diameter to overcome turbulent flow.

The velocity was increased from 8 feet per second to 17 feet per second. The results showed no change in coal density from the specific gravity change attempted. At the higher fluid velocities the raw coal feed rate increased from 30 to 45 TPH to unsuccessfully attempt improvement of higher solids being processed. The results were no better at higher solids or at higher velocities and the turbulence increased.

The next unsuccessful adjustment attempted was varying the vortex finder depth and observing the percent recovery and specific gravity of the cleaned product. Again, the results showed no change in the separation setting or percent recovery. The percent recovery was staying near 40% and the separation setting remained at 1.65 or higher as shown by laboratory float-sink tests.

The next adjustment was to observe the effect of varying the refuse outlet orifice diameter and no change was found.

b. Summary of Results from Adjustment Made on Jigging Cyclones

A summary of the results to improve quality of clean coal recovered produced by the above tests were:

1. Increasing fluid velocity to 17 ft/sec in jigging cyclones did not change the specific gravity separation setting.
2. Changing the percent solids of the slurry feeding the cyclones did not change the specific gravity separation setting, or percent recovery.
3. Variable depth vortex finder settings did not change the percent recovery any noticable amount, or change the specific gravity separation setting.
4. Different size refuse outlet orifice diameters varied the percent recovery but did not show any specific gravity separation setting change.

OBJECTS OF THE INVENTION

An object of the invention is to provide a method for dimensioning and adjusting at a static position the vortex finder and orifice diameter in a separable shallow dish fitted centrifugal separating cyclone having a single inlet delivering streamlined flow into the centrifugal separating cyclone. A cylindrical bowl having a height comparable to its diameter, a vortex finder set above the top of the dish, an outlet pipe at the top of the cyclone converted to the vortex finder for separation of lights and a single orifice at the bottom of the dish.

A further object of the invention is to provide a wear-resistant centrifugal separating cyclone fitted with separable shallow dish for washing crushed coal having a single inlet with deflector delivering streamlined flow into the bowl as disclosed in my copending application Ser. No. 860,330, filed Dec. 14, 1977, a cylindrical body, a shallow dish, a vortex finder adjusted at the top of the dish for a recovery which depends upon the size, sulfur content, fracturability and ash content of the coal and an orifice diameter which sets the recovery together with the diameter adjustment of the vortex finder.

A further object of the invention is to provide a novel quick replacement type of vortex finder kit for varying the diameter to adjust the recovery of coal as set forth in the preceding paragraph.

A still further object is to provide a new wear-resistant replaceable shallow dish with adjustable surface having critical curvatures, the dish being either of two piece or one piece construction and being insertable at the bottom of the cylindrical section.

A still further object is to provide a set of replacable wear-resistant orifices of differing diameters for fitting into the dish construction described in the preceding paragraph.

A further object of the invention is to improve the system of coal washing by a new method of combining recoveries of clean coal from high ash and high sulfur containing coal for meeting the specification for metallurgical grade and steam grade crushed coal by combining relatively low recovery operations in a series of cyclones where the heavies of a first cyclone or series of cyclones at low recovery and relatively high velocity are passed through a second cyclone or second series of cyclones to recover further light fractions therefrom.

A further object of the invention is to provide a system of coal or ore washing by a new method of pulling the light clean coal fraction or ore from the dish and orifice zone at a selected number of revolutions per minute to separate the fraction of clean coal or ore of lower vacuuming resistive forces from the heavier refuse fraction which contains a larger vacuuming resistive force that propels it down and along the curvature of the dish and orifice surface and out through the bottom orifice opening as set forth in the preceding paragraph.

A still further object is to provide a system of coal washing by a new method of recycling the clean coal friction of a preceding stage through another centrifugal separating stage to expose the clean coal particles with tightly bonded pyrites and other coal impurities to additional centrifugal washing and mixing forces to break these bonds and separate the impurities from the clean coal particles.

SUMMARY OF THE INVENTION

Contrary to the low solids, jigging turbulence and low velocity operations of the prior art, it is a fundamental feature of the present invention and the invention in my Case No. 1, Ser. No. 860,330, that:

(1) the pressure drop be high rather than low, at least 0.9 and preferably 1.5 atmospheres above gauge pressure, between the inlet into the cyclone and the outlet above the cyclone leading away from the vortex finder;

(2) the solids content of unwashed coal be at least twice as high, preferably between 2 to 4 times as high (optimally at least 15% and up to 35% solids), compared to that used in Loughner or Visman;

(3) a high flow rate at high solids provide high capacity at lower water requirement for washing than is taught by patents to Visman or Loughner or in the *Chemical Engineer's Handbook;*

(4) the separating capacity of the shallow bottomed cyclone be increased due to forcing the incoming particles into the cyclone bowl toward the tangential wall by deflector means shown in my Case No. 1;

(5) critical settings of the percent recovery be made of the vortex finder area relative to the bottom orifice area to determine the percent recovery at the top of the cyclone;

(6) the selection of the settings be determined by the amount of ash removal and inorganic sulfur removal from unwashed coal, taking into account the grindability of the coal;

(7) the recovery settings vary from 40% to 70% respectively for efficient washing of 10% to 30% mineral ash coal with the optimum for a clean coal at 8% or below in mineral ash being lower than 70% recovery, preferably 50% to 65%.

(8) the percent recovery setting for washing raw coal having 30% to 40% ash be about 35% to 55% and a single outlet plant with a recycling stage be the only choice for such washing, taking into account the particle size of the coals also affects recovery;

(9) a critical replacable wear-resistant dish geometry and replacable wear-resistant orifice geometry which is unique to the present invention be employed to provide reproducibility of ash removal and inorganic sulfur removal;

(10) the critical geometry of the dish be employed, expressed as the first included angle of entry into the dish, $\theta_4$, the second included angle of the dish following the first angle, $\theta_5$. Under streamlined flow, the greatest dangers of reentrainment of cleaned coal occurs because of a first turbulence created at the uppermost edge of the dish and thereafter because of a second turbulence created at the lowermost lip of the dish where the whirling vortex enters the orifice structure. This critical first included angle at the entry into the dish $\theta_4$, lies between 80° and 105° and its function is to overcome the turbulence due to abruptly shortening the diameter of the whirling vortex, e.g., compressing the helix. Accordingly, $\theta_4$ acts as a brake or first gear for the rotational compression of the descending helix. In contrast, Visman has an equivalent angle corresponding to $\theta_4$ of 135°.

The second angle, $\theta_5$, lies between 100° and 115° for the middle zone which is the 30% to 40% intermediate area of the dish to provide the maximum change in acceleration of the whirling particles in about a 120° sector of one rotation of the helix. If $\theta_5$ is too high, e.g., about 120° to 125°, the dish is too flat and the necessary separation of clean, light particles does not occur and efficiency drops. The critical rate of downward acceleration represents an increase in velocity which is 2 to 3 times as great in the dish portion as in the cylindrical portion because of the narrow range of $\theta_5$ between 100° and 115° along a very narrow sector of the revolution. Only $\frac{1}{2}$ to $\frac{5}{8}$ of one revolution of the helix is compressed in the dish while the remainder of the revolution is compressed within the orifice structure. Visman uses the dish portion to create a horizontal partitioning of particles and creates a reverse change from dish to throat curvature lying wholly within the throat of the dish while the change in curvature of the present invention along the common dish orifice wall occurs exclusively in the orifice portion of this common surface. In the invention, the change amounts to about 100°, e.g., $\theta_5$ minus $\theta_9$, where $\theta_9$ is the included angle taper in the orifice.

If $\theta_9$ is substantially less than 12° then the desired throttling compression required in the orifice is not achieved. The last helical revolution of the emerging whirling vortex drops at an accelerated velocity from the top edge of the dish into the central inner portion of the orifice in about the same time along a vertical distance which is 3 times greater than the distance separating adjacent helical turns in the cylindrical portion of the cyclone. This high solids rush towards atmospheric pressure in the constricted orifice creates extraordinary erosion forces.

The invention also is based upon ascertaining the critical setting from analysis of about 190,000 to 200,000 tons of coal the separation characteristics of a shallow bottomed water only cyclone comprising a cylindrical bowl, a single inlet tube, a single bottom orifice in a detachable shallow dish at the cyclone bottom, a fixed vortex finder, a box and an outlet pipe above the vortex finder for removing the light washed particles separated in the cyclone.

A quick-change conical dish supporting plate having openings for nut and bolt fasteners is provided for either a clarifying cyclone, such as the two section long cone dish of Hirsch, U.S. Pat. No. 2,975,896, or for a jigging cyclone, such as Loughner, U.S. Pat. No. 3,887,456, or for the present squat cyclone of critical height to diameter ratio, preferably 0.90 to 0.95. The quick-change plate permits a change of dish, when worn, change of vortex finder, or change of both, from the bottom.

A new vortex finder sleeve kit is also provided which permits changes to be made for adjusting percent recovery and clean coal quality, e.g., reduction of the mineral ash and inorganic sulfur content. This kit may be installed by tack and stitch welding or, for small diameter cyclones, by mirror welding. A bayonet sleeve kit is also described.

The engineering application of critical settings has been summarized in the disclosure of the application for all centrifugal separating cyclones having a broad height to diameter limit of 0.8 to 1.3, preferably 0.90 to 0.95, wherein all cyclone dimensions are expressed in terms of inner bowl diameter, e.g., B. All inlet pipe, outlet pipe, vortex finder sleeve and orifice dimensions are expressed in terms of B and the specific values are shown in Table A herein.

BRIEF DESCRIPTION OF THE DRAWING

FIG. 14 is a graph of the vortex finder diameter settings, the percent of raw coal ash relative to refuse outlet orifice diameter and the cyclone to percent recovery;

FIG. 17 is a diagrammatic view showing the results of a steam coal preparation having a two-stage high ash coal washing circuit; and FIG. 18 is a diagrammatic view showing the results of a premium steam coal preparation having a three-stage high ash coal washing circuit.

Figure 1:
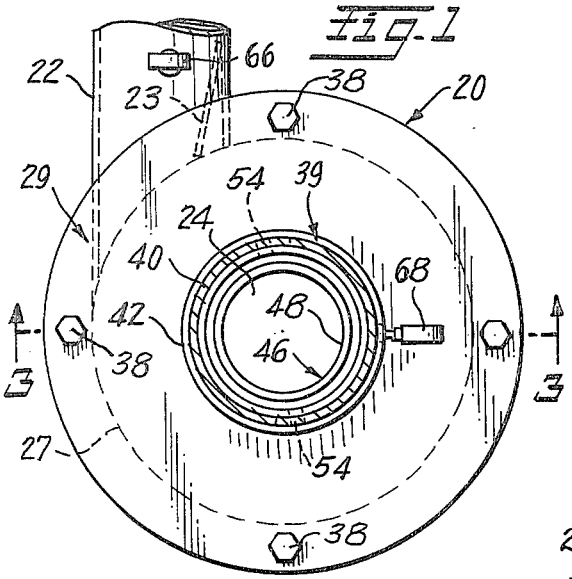
FIG. 1 is a fragmentary plan view of the centrifugal cyclone of the present invention.

In all of the Figs. of the drawing, the views are to scale and in accordance with the Examples, which illustrate operations in an 18" cyclone. The representation of the path of the streamlined flow deflected slurry entering the inlet is based upon actual observation and analysis wherein different methods corroborated the particular path which is shown.

The input to each of the cyclone structures is in the form of crushed coal which may vary up to $1\frac{1}{4}\times 0$ and down to about $\frac{3}{8}\times 0$, the range preferred for coal which is difficult to fracture being $\frac{3}{8}\times 0$ and for easily fracturable coal, $\frac{3}{4}\times 0$, other factors, such as high sulfur or ash content, being taken into account. The narrow range of critical settings for dimensions of the structures and parts is summarized, based upon test data, in Table A herein. This Table A expresses all values in terms of B, inner bowl diameter, to permit prediction of other sizes.

DESCRIPTION OF THE PREFERRED EMBODIMENTS

Figure 2:
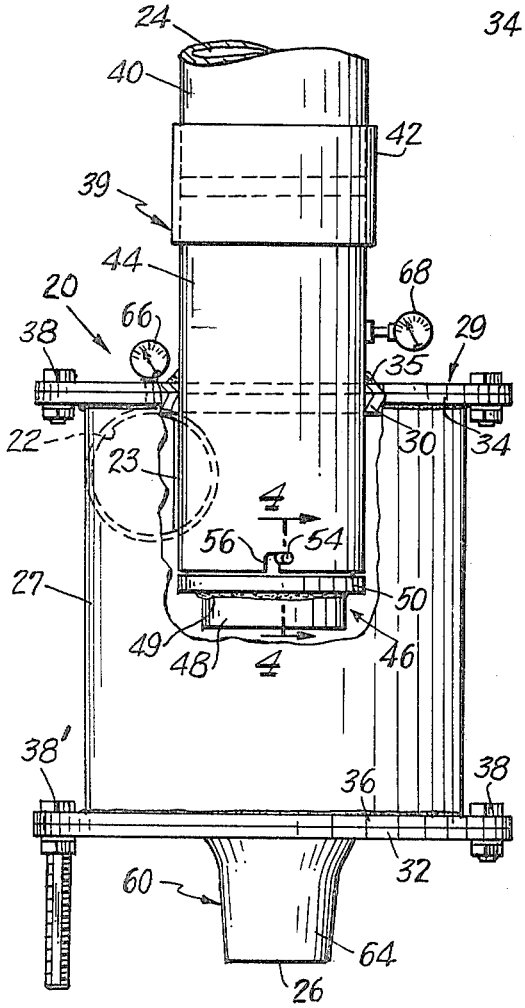
FIG. 2 is a fragmentary elevational view, partly in section, of the cyclone of FIG. 1, having a quick detachable vortex finder sleeve.
Figure 3:
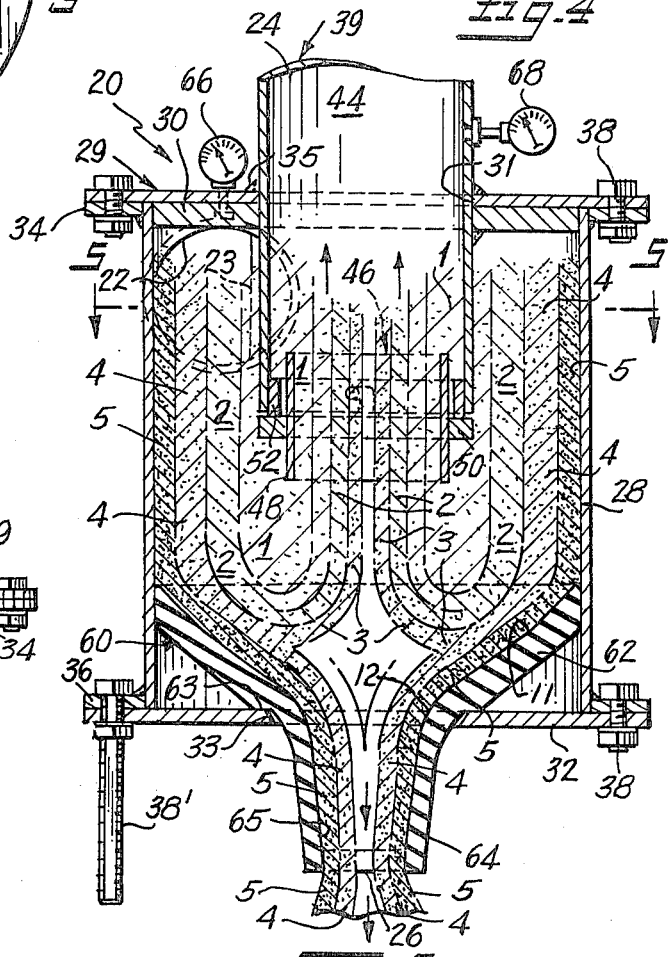
FIG. 3 is an enlarged fragmentary vertical sectional view of the cyclone taken on the line 3—3 of FIG. 1.
Figure 5:
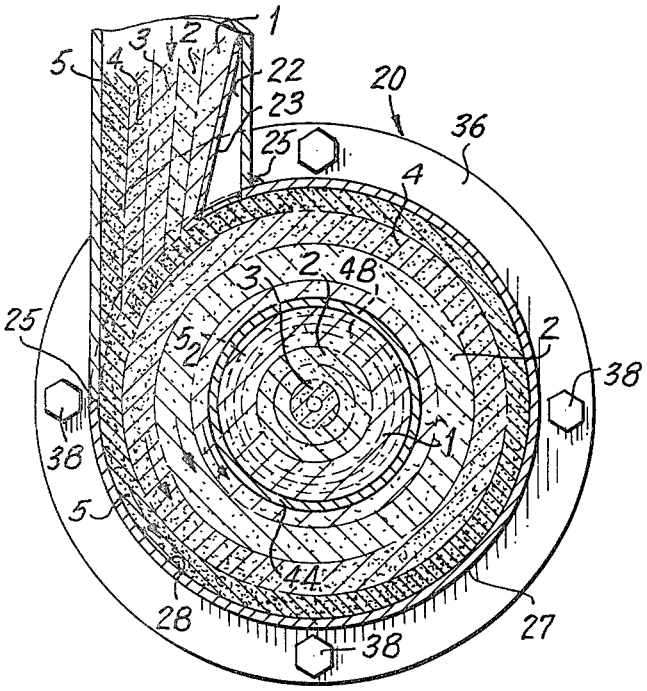
FIG. 5 is a fragmentary horizontal sectional view, taken on the line 5—5 of FIG. 3.
Figure 6:
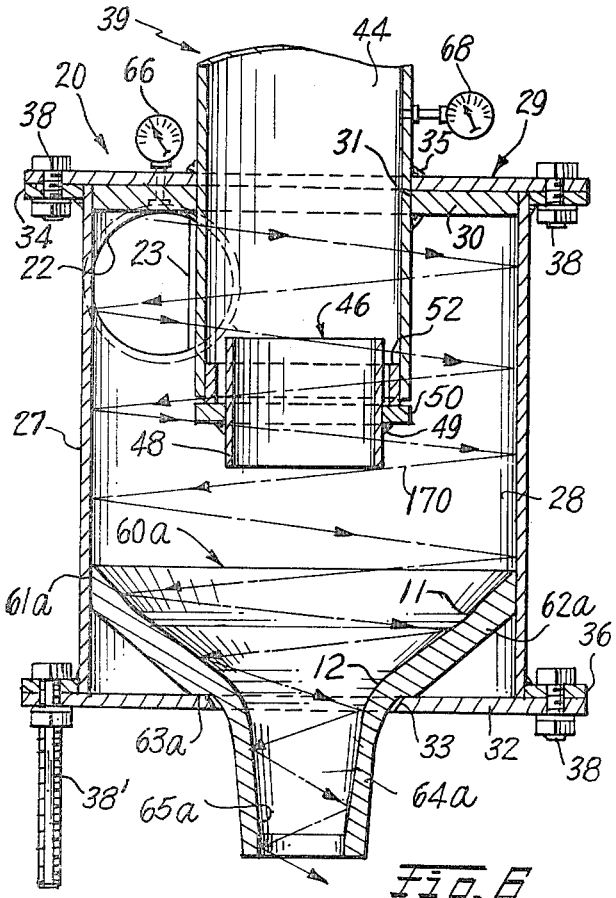
FIG. 6 is a vertical sectional view, similar to FIG. 3, showing the path of the spiral turns of the processed material within the cyclone as it progresses toward the bottom orifice.

The embodiments illustrated in the accompanying drawings and following description and examples exemplify the new and patentable changes over my prior application, Ser. No. 860,330, filed Dec. 14, 1977 and show the best modes of carrying out the present invention. These changes comprise:

(1) Quick-change mounting plate 32 and fasteners 38 including elongated fixture bolt 38' used for quickly replacing either the vortex finder-sleeve kit 46 or the one piece dish 62, 62A, 72, 82 and 92, orifice 64, 64A, 74, 84 and 94, or both (See FIGS. 2, 3 and 6). Unskilled personnel can change either or both in about five minutes or less. This quick change means is essential in order to quickly accommodate to a different raw coal feed, and to replace the vortex finder-sleeve 46 or to replace a worn dish 62, 62A, 72, 83 and 92, or to install a different size dish 62, 62A, 72, 82 and 92. Any or all of these might have to be done with a change in raw coal and a replacement of a worn part.

Figure 12:
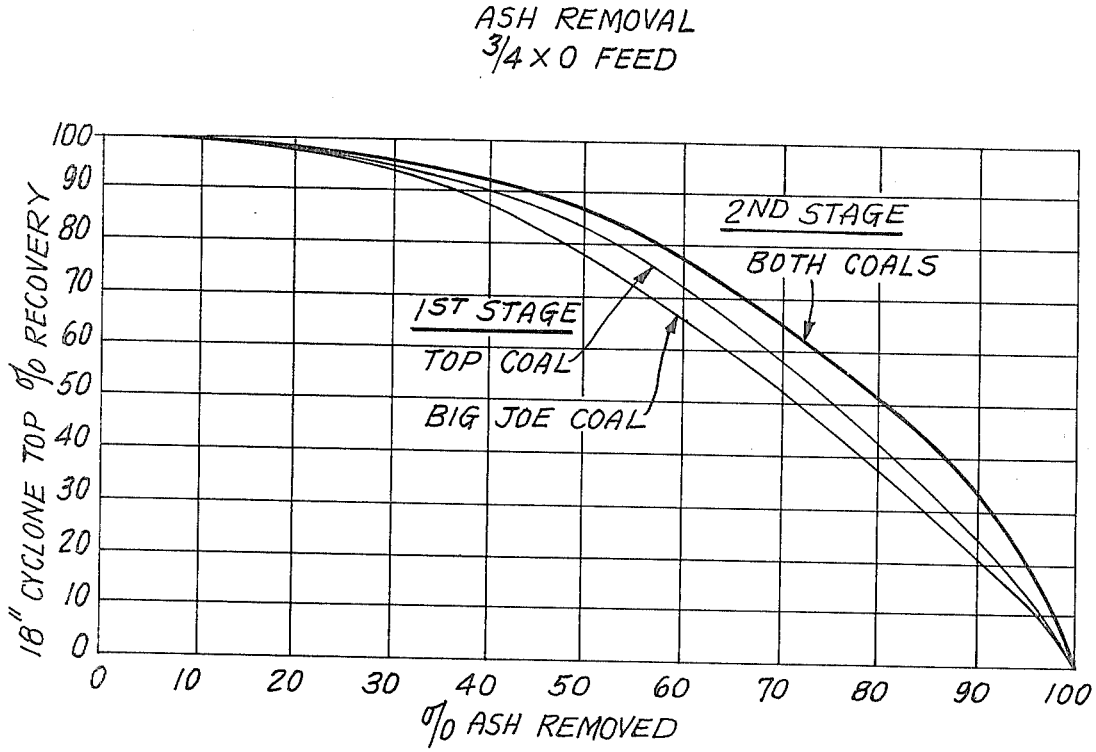
FIG. 12 is a graph of the ash removal relative to the percent of recovery.
Figure 13:
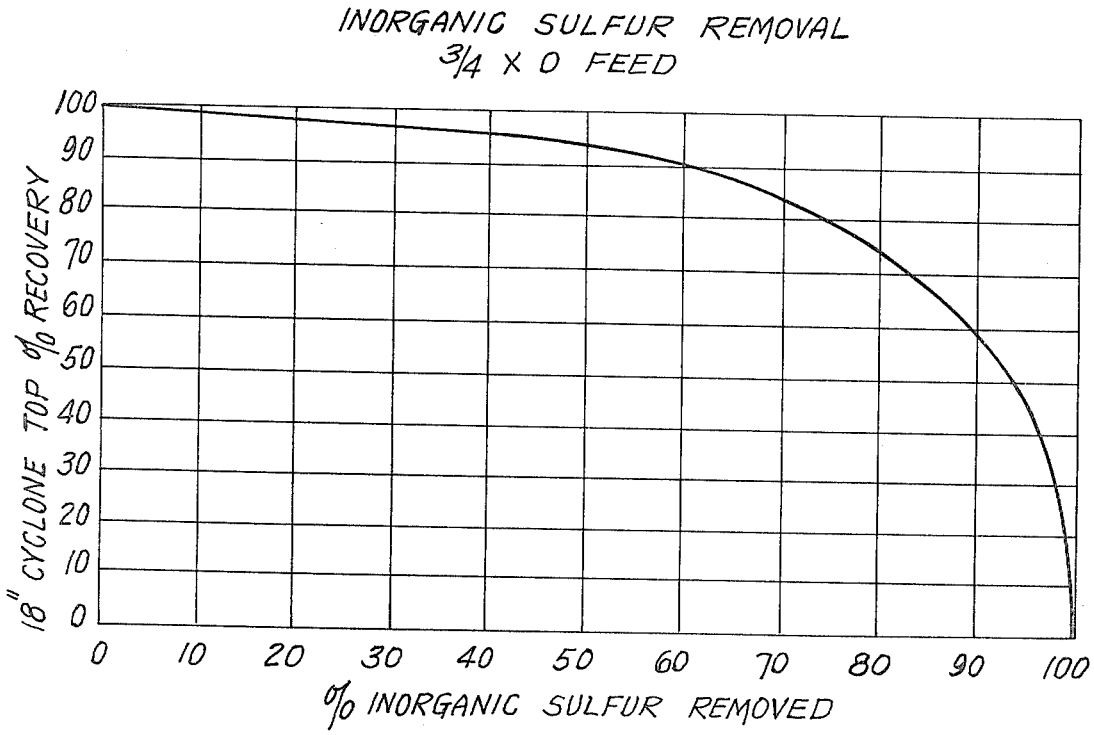
FIG. 13 is a graph of the inorganic sulphur removal relative to the percent of recovery.

(2) Critical Cyclone Dish 62, 62A, 72, 82 and 92 and Vortex Finder Sleeve dimensions 46, 146 and 246, are shown in FIGS. 15, 16, 17 and 18, and the Empirical Settings shown in FIGS. 12, 13 and 14 and Table A, to maximize clean coal quality and recovery where only the values of raw coal ash, sulfur and fractionability are the variables to determine the required settings of the vortex finder-sleeve.

Figure 9:
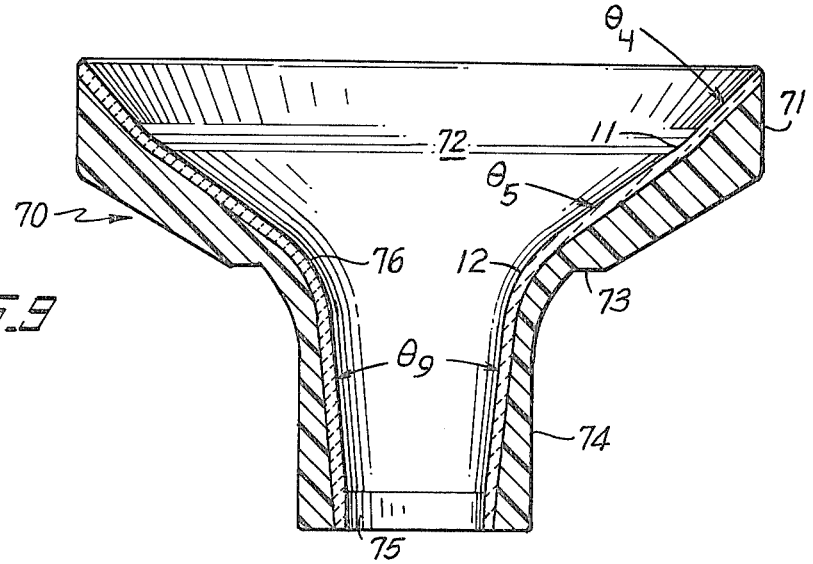
FIGS. 9, 10 and 11 are enlarged vertical, sectional views showing modifications of the cyclone dish and refuse outlet orifice member.
Figure 10:
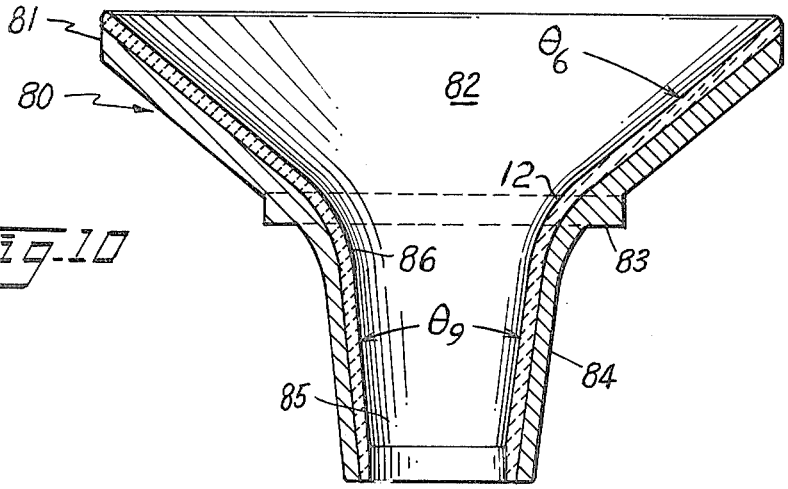
Figure 11:
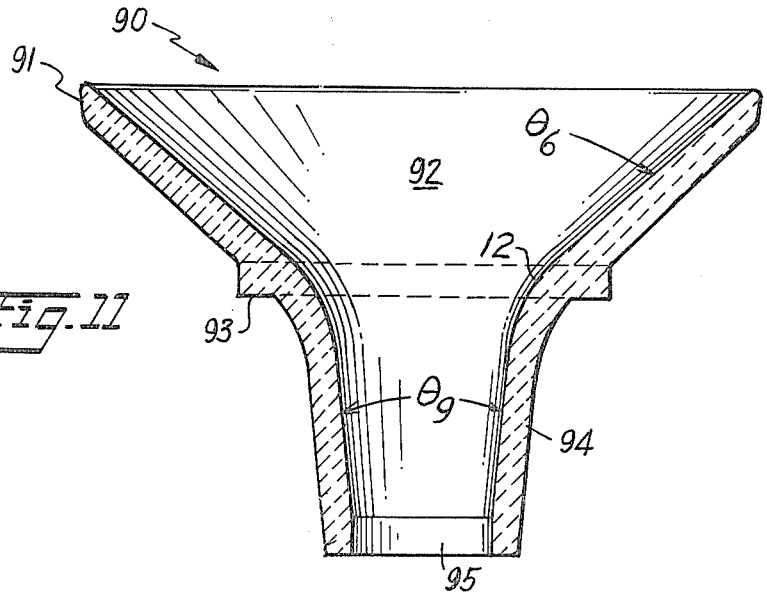

(3) One-Piece Shallow Bottom Dish Orifice 60, 60A, 70, 80 and 90, these best shown in FIGS. 3, 6, 9, 10 and 11 consist of special erosion resistant materials, namely rubber in FIG. 3, alloy in FIG. 6, ceramic liner with rubber layer backing in FIG. 9, ceramic liner with metal backing in FIG. 10, ceramic in FIG. 11, which are suitable materials for all figures.

(4) Quick change Vortex Finder Sleeve Kit shown by elements 46, 146 and 246, is adapted to maximize the quality and recovery of clean coal as shown in FIGS. 12, 13, 14, 15, 16, 17 and 18.

(5) Critical Geometry of One-Piece Shallow Bottom Dish-Orifice 60, 60A, 70, 80 and 90, to maximize clean coal quality and recovery as shown in FIGS. 12, 13, 14, 15, 16, 17 and 18.

(6) Operating settings shown in FIG. 14 under (2) to maximize centrifugal separation at selected velocities, raw coal particle size and solids concentration in coal slurry.

(7) Critical location of cyclone parts, shown in FIGS. 1, 3, 5 and 6, to minimize wear and avoid turbulence.

I.

(1) Quick Change Mounting Plate 32 and Fasteners 38 Including Elongated Pivot Bolt 38'

(a) Relationship of Quick Change Plate Shown In Drawings to Case 1, Ser. No. 860,330, Filed Dec. 14, 1977

The preferred embodiments illustrated in the drawings are based upon painstaking operations analyses of 200,000 tons of coal washing in the plant and by the method as disclosed and claimed in my prior application, Case No. 1, Ser. No. 860,330, filed Dec. 14, 1977, entitled Inlet Line Deflector and Equalizer Means for a Centrifugal Cyclone Used for Washing and Method of Washing Using Deflectors and Equalizers, and also the divisional applications thereof, namely:

| Case No. | Serial No. | Filing Date | Title |
|---|---|---|---|
| I-II | 026,128 | 07/19/78 | Method of Manufacturing Installing an Inlet Line Deflector in a Centrifugal Cyclone for Washing Coal |
| I-III | 926,058 now U.S. Pat. No. 4,164,467 | 07/19/78 | Coal Washing Plant Using Deflectors |
| I-IV | 973,408 | 12/26/78 | Crushed Raw Coal Washing Plant Using A Plurality of Deflector Fitted Centrifugal Cyclones to Produce A Washed, and Dried Mixture of Clean Coarse and Fine Coal, and Fine Coal Alone, with Means to Remove Refuse and Means to Recycle Clean Fine Coal Slurry By-Product into Raw Crushed Coal Inlet |

(b) Single and Multi-Stage Operation of the Deflector Fitted Cyclone of Ser. No. 860,330, filed Dec. 14, 1977

The centrifugal separation method in my prior application Ser. No. 860,330 had shown tremendous promise when washing George's Creek refuse piles (referred to as Bone Piles). By changing from jig washing to centrifugal washing and adjusting the recovery, FIGS. 12, 13 and 14, the output clean coal quality was improved from 18% mineral ash to 11% mineral ash and a few examples were observed producing 8% mineral ash clean coal.

Applicant's follow-up experiments attempted to discover the 18" cyclone critical settings, FIGS. 12, 13 and 14, Ser. No. 860,330 in a 3-cyclone, 2-stage plant and used run of the mine coal to attempt a vortex setting, FIG. 14, for less than a 1.45 sp. gr. separation. These experiments resulted in a percent of clean coal recovery, FIGS. 12, 13 and 14, for the first stage cyclones 20 of 81.5% average over the first 15 days of operation. However, as the % recovery, FIGS. 12, 13 and 14, of clean coal out the top 24 of the cyclone 20 increased the amount of higher specific gravity particles (refuse) reporting to the clean coal stream also increased throughout the 15 day period. This two-stage, single clean coal outlet, centrifugal cyclone 20 plant, recovered an excessive amount of middlings in the clean coal and failed to produce the desired metallurgical coal quality of less than 8% ash. Although the total 2-stage plant recovery, FIG. 17, using 3 cyclones was correctly set at 75–85% by the vortex finder 146, it was discovered that the percent recovery, FIGS. 12 and 13, was inversely proportional to the clean coal quality, FIGS. 12 and 13, and a systematic study was initiated to ascertain the critical settings, FIG. 14, (Ser. No. 860,330).

There is shown in FIGS. 1, 2, 3, 5, 6, 7 and 8 herein a centrifugal cyclone 20 fitted with deflector 23 for creating streamlined flow in a "water only" coal washing. As described in Ser. No. 860,330 and in the divisional applications filed thereunder, the centrifugal cyclone 20 is used to create streamlined flow in a continuous coal washing plant comprising a slurry tank for mixing raw crushed coal and water, a pump feeding the slurry through an inlet 22 into centrifugal cyclones 20, a plurality of centrifugal cyclones 20, each cyclone 20 having two outlets 24 and 26, one outlet 24 at the top and the other refuse outlet 26 at the bottom of each cyclone 20, and one inlet 22 into the cyclone bowl B (28) within housing 27. The inlet 22 is fed by a pump with the slurry of crushed raw coal and water to undergo separation under centrifugal forces whereby clean coal is separated at the top outlet 24 of each cyclone 20 and heavy refuse in withdrawn from the bottom outlet 26. The clean coal consists of coarse coal particles and fine coal particles in water circulating in a closed clean coal circuit as shown in the aforesaid Ser. No. 860,330.

It is a critical feature of the aforesaid Ser. No. 860,330 to install a generally flat deflection surface 23 into the inlet tube 22 of each cyclone 20 at three critical angles relative to the inlet tube 22 and cyclone bowl 28:

(1) a center angle made by the inwardly displaced bottom of surface 23 relative to the tube 22 centerline being between 116° and 148°;

(2) the deflection angle made by the flat deflection surface 23 relative to the non-tangential feed tube 22 wall being between 8° and 12°; and (3) the included angle between the radius of the cyclone bowl 28 and the flat deflection surface 23 being between 120° and 170° to thereby separate clean coal at the outlet 24 at the top and refuse at the bottom 26 of the cyclone 20.

After separation, the washing process in Ser. No. 860,330 continues by feeding the clean coal output to a dewatering screen to reduce the water content of the clean coal and then to a centrifugal dryer while feeding the separated water containing fine coal below said screen to a fine coal drying circuit.

The method of washing in Ser. No. 860,330 includes feeding the fine clean coal slurry separated in an earlier stage to a clarifying circuit for the removal of the fine clean coal and separating clarified water for reuse in the first, second or third stage slurry tanks in a three-stage process. Each coal batch analysis of sulfur and ash dictated a different optimum dimension of vortex finder diameter D, in order to reach clean coal quality.

The water content of the fine clean coal slurry is reduced by pumping it into clarifying cyclones to separate the slurry into a clarified water portion for reuse in the first, second and third stage slurry tanks and a dewatered portion for further drying to yield a dried clean coal product.

The dewatered fine clean coal with reduced moisture content is produced at a value permitting storage of the centrifugally dried fine coal and the removed fine clean coal particles in water which pass through the fine clean coal centrifugal dryer basket are recycled with the crushed coal in the first, second and third stage slurry tanks with water whereby a constant level of reused fine coal is built up to a value of about 5% in the total plant circuit to push fine clean coal out of the system in continuous operation.

FIG. 3 herein shows the separated interior zones 1, 2, 3, 4 and 5 in the cyclone 20 to illustrate vertical layering due to deflector 23. The development of vertical stratification layers 1, 2, 3, 4 and 5 in the cross hatched shading result also from pressure differential between gauges 66 and 68 and the installation of the deflector 23 as is best shown in FIG. 3.

Layers 3 and 4 represent the middling coal. In path washing which is the main objective, clean coal transfers into layers 1 and 2, and part of 3 and as illustrated may be the 1.5 specific gravity layer containing the 1.5 specific gravity middlings. Layers 4 and 5 may be the 1.6+ specific gravity layer containing refuse of 2.6+ specific gravity containing clays, pyrites, etc.

FIG. 3 herein and FIG. 1 differ in respect to the introduction of threaded pivot or fixture bolt 38' which is of critical length, threaded at the top and bottom to permit the nut to be shifted from top to bottom, to drop plate 32 while supporting the shallow dish and pivot both dish and plate clockwise for immediate access. The need for the quick opening arrangement also occurs in the frequent requirement to replace parts whose wear alters % recovery and clean coal quality (ash). Recognizing these needs was based upon over a thousand hours of analysis of results of washing and unrecognized mistakes were later uncovered by analyses. Later experiments where the results of FIG. 14 washing in Ser. No. 860,330 show failure to reproduce the limits of washing found in the first experiments, the selected vortex finder settings were found to be altered also by differences in fractionability of the coal, especially in respect to the sulfur content which could be removed by centrifugal washing. Thus, it was obvious that quick changes were needed to make different settings of Vortex Finder D and the detailed aspects are described below.

(c) Distinctive Details of Members 60, 60A, 70, 80 and 90 in FIGS. 3, 6, 9, 10 and 11

It is a critical feature of the present invention shown in FIGS. 3 and 6, that a single circular bottom plate 32, be provided with a single beveled circular central orifice 33, proportioned precisely to encompass the beveled shoulder between the top of the orifice 64, 64A, 74, 84 and 94 and the bottom of the shallow dishes 62, 62A, 72, 82 and 92.

The bottom plate 32 has the appearance of a giant washer and the edges are provided with suitable openings for a plurality of threaded fasteners 38 including elongated fixture bolt 38 of the nut and bolt type. In one embodiment these lie equally spaced on a common circle at the cardinal compass points, for example, 0°, 90°, 180°, 270°. However, two fasteners 38, 180° apart, three fasteners 38, 120° apart, have been used with equal success. Five fasteners 38 are not necessary.

It is a unique advantage of this single circular bolt fastened plate 32 with small center hold 33 and fixture bolt 38' that the shallow dishes 62, 62A, 72, 82 and 92, orifices 64, vortex finder housing 44 and vortex finder-sleeve 46 are all fixed by the single plate 32 to share a common axis which is the axis of cyclone 20.

(d) Utility of Quick Change Plate 32 For Jigging Cyclones and Other Cyclones

The novel quick change mounting plate 32 and fasteners 38 with elongated pivot bolt 38' is particularly adapted for improving the operation of the jigging cyclone disclosed in Loughner U.S. Pat. No. 3,887,456, and especially for changing the setting of the vortex finder in that patent.

Note that in Loughner, FIG. 1, plate 17 is seemingly fastened to the dish 20 and also is the bottom of the flange 16 at the base of cylindrical bowl wall 11. A plurality of bolts 18 fasten the flange 16 to plate 17 and a plurality of bolts (not numbered) fasten the separable orifice to the bottom portion of the dish 20 and plate. In short, the inner bolts of Loughner connect three parts, e.g., plate, orifice and dish, and the outer bolts connect two parts, plate and the cyclone bottom flange.

Replacing the vortex finder 46, 146 and 246 with another of different diameter requires opening at least two sets of bolts and removing both the dish and orifice together with the bottom plate of Loughner's jigging dish.

Prior to removing the dish, it is required to remove the adhesive cement which bonds dish 20 to the inner bowl wall 11 at 21. Thus, even if a change in vortex diameter dimension is contemplated and dismantling operation is long and complicated regardless of the difficulty of vortex finder replacement and for this reason, this jigging cyclone cannot by easily adjusted.

In contrast, the invention permits resetting critical parameters determining cyclone operation through the bottom by removing as few as two bolts, partly due to the novel one piece dish-orifice construction and partly due to the novel vortex finder sleeve kit, while uniquely providing a totally new environment for replacement by using an elongated alignment and pivot bolt 38' (FIGS. 2, 3, 6) which can serve as a keeper to hold the one piece dish from the opening in the same flange 16 as in Loughner.

The present invention has attempted to change the vortex finder 46, 146 and 246 diameter by replacement in the apparatus of Loughner first by dismantling the top and then by dismantling the bottom. Dismantling from the top took about one (1) hour. It took about one-quarter ($\frac{1}{4}$) hour longer to install the new, narrower vortex finder sleeve, and then to fix it.

In contrast, the bottom changing operation in accordance with the present invention takes five (5) minutes or less, using the novel vortex finder sleeve kit 46 of the invention as described in Section (4) below.

Similarly, changing a dish to alter recovery or quality of washed coal in Loughner's jigging cyclone requires that forty-five (45) minutes to one (1) hour for cement removal and unbolting and rebolting operations. With the invention, the time is about one-tenth (1/10) that in Loughner.

Also, there is no need in the present invention to change the orifice as in Loughner. This need is accomplished in the invention by simply changing the dish 62, 62A, 72, 82 and 92, which with the orifice 64, 64A, 74, 84 and 94, makes one unit 60, 60A, 70, 80 and 90. In FIGS. 9, 10 and 11 there are shown dishes of different wear resistant materials having respective cylindrical edge portions 71, 81, 91. A new cooperation between dish 62, 62A, 72, 82 and 92 and orifice 64, 64A, 74, 84 and 94 exists in the invention, based upon geometry, Table A, of the one-piece structure 60, 60A, 70, 80 and 90 which is described in Section (5) below.

Visman U.S. Pat. No. RE 26,720 is like Loughner U.S. Pat. No. 3,887,456 in respect to requiring opening the cyclone from the top either to change the vortex finder setting, e.g., the distance between the lowest edge of the vortex finder to the top edge of the dish (see FIG. 1 in Visman). In contrast to Loughner's dish which is cemented at the outer thin upper edge to the inner circular wall of the cyclone, Visman bolts his conical dish in the form of a casting as drawn in FIG. 1 by means of bolts through the flange extending outwardly from the top frustrum 16 of the cone and this flange of the dish mates with the lower flange of the cyclone bowl.

The present quick change plate fitted with an elongated bolt fixture distinguishes over Visman in permitting immediate access to change the vortex finder from the bottom—there is no corresponding bottom quick change in Visman. Also, there is no need to remove the dish with the quick change plate and fixture bolt when only the vortex finder and its sleeve are changed. The old dish is suspended by means of the fixture bolt. These same differences distinguish over Loughner also.

Figure 4:
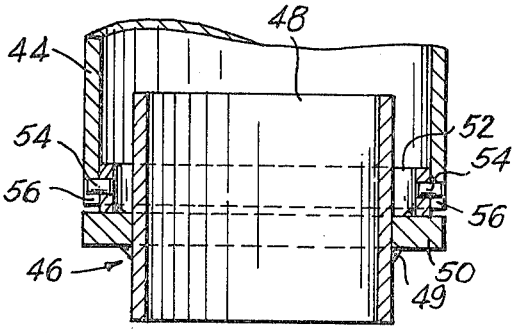
FIG. 4 is an enlarged fragmentary vertical sectional view through the detachable vortex finder sleeve of the cyclone of FIG. 1.
Figure 7:
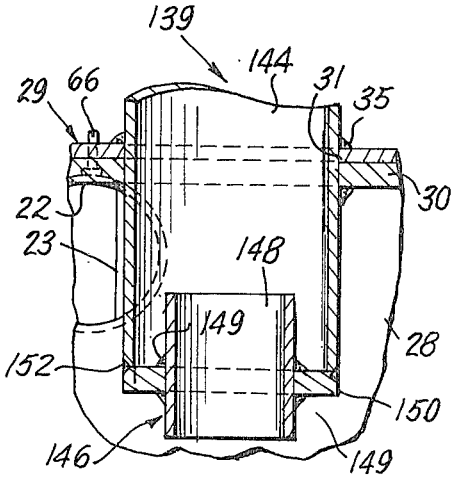
FIGS. 7 and 8 are fragmentary vertical sectional views illustrating modifications of the vortex finder sleeves.
Figure 8:
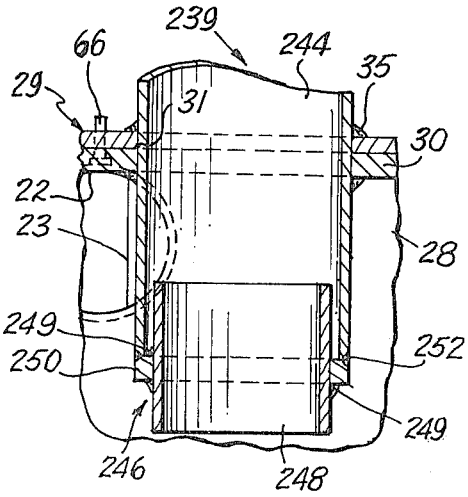
Figure 16:
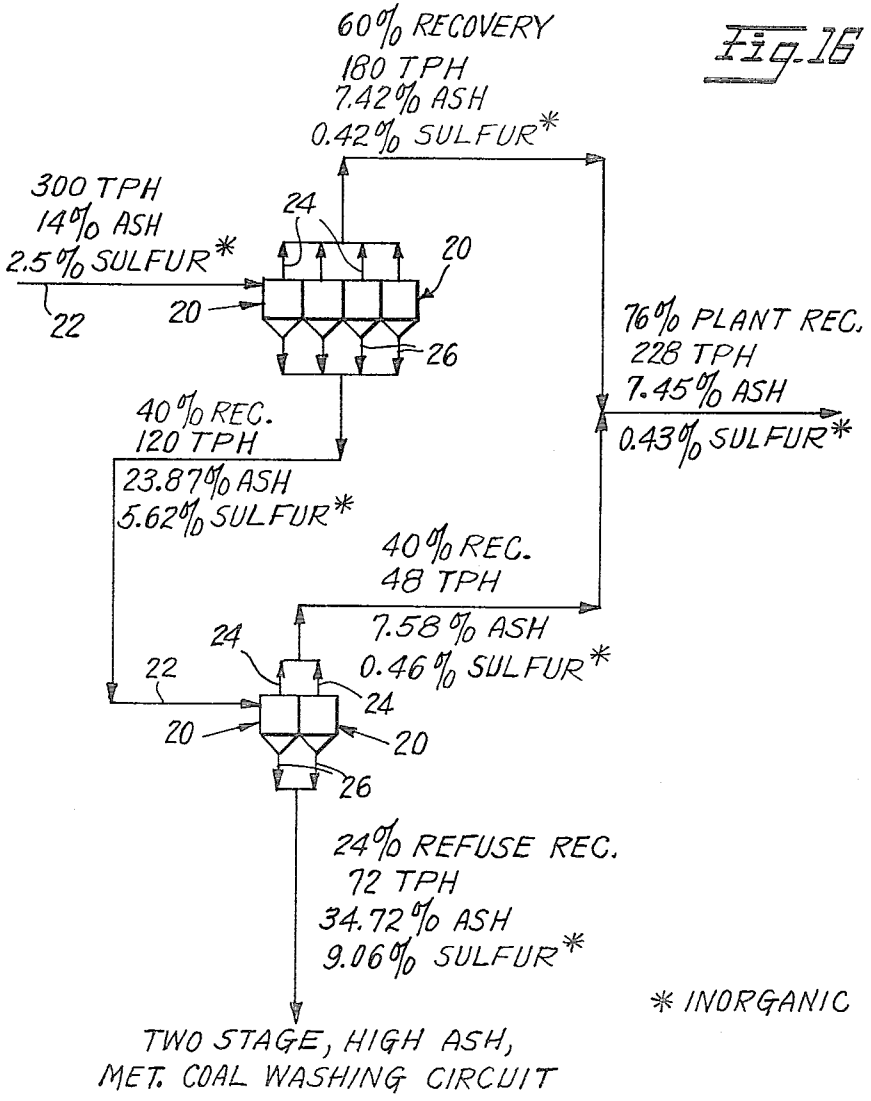
FIG. 16 is a diagrammatic view showing the results of a met. coal preparation having a two-stage high ash coal washing circuit.

The vortex finder sleeve kit shown best in FIGS. 2, 4, 7 and 8 which is described in greater detail in Part (4) which follows hereafter may be of the weld on type as shown in FIGS. 7 and 8 or may be of the bayonet socket type shown in FIGS. 2, 4 and 6. To convert from a larger vortex finder area based on the diameter D shown in Table A, to a smaller vortex finder area is the first step needed to reduce recovery of washed coal. This reduction is dictated by the settings illustrated in FIGS. 12 and 13 in meeting the requirements for clean coal quality of metallurgical grade coal as is shown in FIG. 16 which illustrates metallurgical coal preparation having high ash coal washing circuit, this Fig. further showing the material balance for the two-stage circuit shown therein.

A still more important difference over Loughner and Visman, which are the closest prior art to the present invention, is that neither ever conceived the need to change the vortex finder diameter. Only the inventor has made this discovery and it is fully explained in the description of critical parameters which follows.

In summary, the adaptability of the present plate support 32 in combination with the pivoting fixture bolt 38' to every type of cyclone, whether a jigging cyclone such as Loughner, or a gravity separator as Visman or pulp clarifier as in Hirsch U.S. Pat. No. 2,975,896 is based upon the present discovery that the plate provides a central aligning opening 33 which cooperates with the upper section of the conical dish in each example of these patents to serve as the sole support and to thereby align the center axis of the dish with the center axis of the vortex finder along a common line, the length of the pivoting fixture bolt being just slightly greater than the upper projection dish wall within the cyclone to permit this dish wall to drop a distance which permits pivoting the dish clockwise out of the center of the cyclone to be to a side for while suspended by the fixture bolt.

II.

Critical Cyclone Dish and Vortex Finder Dimensions to Maximize Clean Coal

A. Parameters Studied

The following parameters were systematically studied:

Structural and Operating Parameters

1. The correct vortex finder 39 sleeve 46, 146, 246 settings, FIG. 14, were studied to determine the specific gravity separation setting, e.g., the diameter settings;
2. The critical cyclone 20 and cyclone part dimensions, Table A, and settings, FIG. 14, for efficiency limits, FIGS. 12 and 13, of centrifugal optimum separation, diameters and heights of cyclone variables;
3. The maximum mineral ash removal, FIG. 12, based on optimum cyclone 20 dimensions, Table A, and settings, FIG. 14, in single and multistage operation.
4. The maximum inorganic sulphur removal, FIG. 13, based on the same factors in (3).
5. Washing stages, FIGS. 15, 16, 17 and 18, required for processing the sizes and different types of raw coal feed.
6. The average particle size of crushed coal before washing.
7. The critical geometry of dish 62, 62A, 72, 83, and 92 and bottom orifice 64, 64A, 74, 84 and 94 to maximize the equipment life without reducing separation efficiency, FIGS. 12, 13 and 14 herein cited for efficiencies and FIGS. 3, 6, 9, 10 and 11 herein cited for the dishes.

B. Structural and Operational Factors Predetermining Clean Coal Quality

The clean coal quality is controlled by certain factors, some of which are:

1. The percent clean coal recovery setting, FIGS. 12 and 13.
2. The inside geometry of the dish and orifice unit 60, 60A, 70, 80 and 90 of FIGS. 3, 6, 9, 10 and 11. Turbulence must be kept at a minimum. Smooth flow is essential. No irregularities can be allowed within the dish orifice unit 60, 60A, 70, 80 and 90 of FIGS. 3, 6, 9, 10 and 11. These set up disturbing flow patterns that cause obvious remixing of clean coal and refuse.
3. The swirling flow stream within the cyclone bowl 27 of FIGS. 1, 2, 3, 5 and 6.
4. The intersection angle in FIG. 5 between the deflector 23 and the tangent of bowl wall 28 of the inlet flow stream developing zones 1, 2, 3, 4 and 5 with the swirling flow stream within the cyclone bowl 28.
5. The depth C of the vortex finder sleeve 46, (Table A) 146 and 246 in FIGS. 2, 3, 6, 7 and 8 between plate 30 and the bottom of vortex finder 46, 146 and 246 of the vortex finder sleeve setting C (Table A) which remain fixed.
6. The height above the inlet 22, called the cyclone bowl head between 22 and 30, which is fixed and kept at zero or a minimum.
7. A smooth gradual transition from the cyclone bowl wall 28 into the dish 62, 62A, 72, 82 and 92 and orifice 64, 64A, 74, 84 and 94 unit 60, 60A, 70, 80 and 90.
8. First conical frustum $\theta_4$ in dish 62, 62A, 72, 82 and 92. (Table A)
9. Second conical frustum $\theta_5$ in dish 62, 62A, 72, 82 and 92 and with the combination of (8) and (9) equalling about 100° total included angle from the dish 62, 62A, 72, 82 and 92 entrance to the throat top M.
10. Third conical frustum of continuously changing angle $\Delta\theta$ from about 110° to about 12° over a short radius section between the dish 62, 62A, 72, 82 and 92 and orifice 64, 64A, 74, 84 and 94 unit 60, 60A, 70, 80 and 90. (Table A)
11. Fourth conical frustum being the included angle $\theta_9$, Table A (preferably 12°).
12. Fifth straight cylindrical short sections E and S, Table A.

In items (8) to (12) all conical and tapering sections are adjoined by smooth transition curves so as not to create any abrupt flow disturbances. (See FIGS. 3, 6, 9, 10 and 11 and particularly reference numerals 11 and 12.

13. % Inorganic sulphur removed, FIG. 13, at optimum particle size $\frac{1}{2}\times 0$ for easily fracturable coal and less for more difficult fracturing coal.
14. The influence of primary mineral impurities in coal on the fracturability in the preparation of $\frac{1}{2}\times 0$ size crushed coal for washing.

C. Critical Factors Effecting Clean Coal Recovery, FIGS. 12, 13 and 14

Clean coal recovery, FIGS. 12, 13 and 14, is controlled by four critical factors of which three are variable and can be adjusted by plant personnel. No. 3 and No. 4 are held constant, leaving only No. 2 for adjustment.

1. The % ash in the raw coal feed to the plant.
2. The diameter D of cylinder 48, 148 and 248 at minimum length of about 0.3B of the clean coal outlet 24 called the vortex finder sleeve 46, 146 and 246.
3. The diameter E and length J of the refuse outlet 26 called the bottom orifice 64, 64A, 74, 84 and 94. (Table A)
4. The inside geometry of the dish-orifice unit 60, 60A, 70, 80 and 90 which was solved during the wear problem and it remains fixed.

Although, in the washing of relatively coarse, raw crushed coal in the range of $\frac{3}{4}\times 0$ to $\frac{1}{2}\times 0$ and the like, it has been observed that only about 12% to about 20% of this size is crushed coal has a particle size less than 32 mesh to be properly qualified as fines. If coal is moderately difficult to fracture, it has more fines, e.g., closer to 20%.

These fines build up during recirculation of "water only", which is the water medium, and change the recovery settings as shown in FIG. 14. Note clean coal recirculation at the top corners of FIG. 14. This represents a shift in the scale to predict cyclone top percent recovery from the vortex finder sleeve diameter.

TABLE A

BEST MODE AND RANGE OF SELECTED CYCLONE DIMENSIONS SIZE EXPRESSED IN TERMS OF BOWL DIAMETER AND INCHES (ID) OF 18" BOWL SHOWN BY REFERENCE NUMERAL 28 IN FIGS. 1, 2, 3, 5, AND 6

| | | | Dimensions of Larger & Smaller Cyclone Parts are Proportional for Each Part to "B" Product Values in Column 6 Below | | | | |
|---|---|---|---|---|---|---|---|
| Figure Number | Reference Number | Part | Identifying Letter | Preferred Size in Inches | Preferred Size Expressed in Terms of B | Range in Terms of B | Range in Inches |
| 5,6,7, 8 | 28 | Bowl Diameter | B | 18.0 | 1.00 | | |
| 1,2,3,5 6,7,8 | 22 | Inlet Tube | A | 6.0 | .33 | .25–.35 | 4.5–6.4 |
| 3,6 | 60 & 48 60a & 48 | Vortex Finder Depth Between | C | 4.3 | .23 | .00–.26 | 0.0–4.8 |
| 3,4,6 7,8 | 48,46, 148,248 | Vortex Finder Sleeve I.D. | D | 6.5 | .36 | .30–.50 | 5.5–9.0 |
| 3,6,9, 10,11 | 26,75, 95 | Orifice Small I.D. | E | 3.6 | .21 | .16–.25 | 3.0–4.5 |
| 3,5,6 | 44 & 28 | Bowl Width Between | F | 4.2 | .23 | .20–.31 | 3.6–5.6 |
| 3,6,9 | | $\theta_4$ Included Angle Depth | G | 2.0 | .11 | .00–.24 | 0.0–4.4 |
| 3,6,9 10,11 | 60,60a, 70,80 90 | Dish-Orifice Unit Height | H | 12.4 | .69 | .56–1.0 | 10.0–18.0 |
| 3,6,9 10,11 | | Dish Height, Between Dish Top & Plate 32 | $H_1$ | 5.4 | .30 | .19–.67 | 3.4–12.1 |
| 3,6,9 10,11 | | Height of Orifice, Between Plate 32 Top & Orifice Bottom | J | 7.0 | .39 | .15–.67 | 2.7–12.1 |
| 2,3,6 | 29 & 32 | Bowl Height Between | K | 22.0 | 1.22 | 1.12–1.32 | 20.1–23.8 |
| 3,6 | 30 & 60 30 & 60a | Dish Depth Between | L | 16.7 | .93 | .82–1.0 | 14.7–18.0 |
| 3,6,9 10,11 | | Dia. at Throat Entrance to Radius N | M | 7.1 | .39 | .28–.51 | 5.0–9.2 |
| 3,6,9 10.11 | 12 | Radius Connecting $\theta_4$–$\theta_9$ | N | 3.5 | .20 | .18–.21 | 3.2–3.8 |
| 3,6,9 | 11 | Radius Connecting $\theta_5$–$\theta_6$–$\theta_9$ | P | 4.5 | .25 | .19–.28 | 3.4–5.1 |
| 3,6,9 10,11 | | $\Delta\theta$ Depth or Height of Radius 12 | Q | 2.5 | .14 | .06–.28 | 1.0–5.1 |
| 3,6,9 10,11 | 26,75 95 | Orifice Small I.D. Height | S | 1.0 | .06 | .00–.22 | 0.0–4.0 |
| 3,6,9 10,11 | | Throat Height Between M & Top of S | T | 6.9 | .38 | .11–.67 | 1.9–12.1 |
| 3,6,9 10,11 | 64,64a 74,84 94 | Orifice Bottom Outside Dia. | W | 5.0 | .28 | .19–.56 | 3.4–10.1 |
| 3,6,9 | | $\theta_5$ Depth Between G & M | Y | 2.4 | .13 | .00–.33 | 0.0–6.0 |
| 3,6 | | Depth from Inlet 22 to Dish Top 62, etc. | Z | 9.7 | .54 | .22–1.0 | 3.9–18.0 |
| 3,6,9 | $\theta_4$ | Dish Top included Angle | $\theta_4$ | 85° | | ±15° | |
| 3,6,9 | $\theta_5$ | Dish Bottom Included Angle | $\theta_5$ | 110° | ±15° | | |
| 10,11 | $\theta_6$ | Dish Single Included Angle | $\theta_6$ | 100° | | ±15° | |
| 9,10,11 | $\theta_9$ | Orifice Included Angle Between Radius 12 & E | $\theta_9$ | 12° | | +7° −3° | |

E. General Theory of Centrifugal Separation

As stated in Kirk-Othmer *Encyclopedia of Chemical Technology,* Vol. 4, sec. ed. 1964, the capacity of any liquid to solid separation in any centrifugal separator depends upon characteristics of the equipment. This is especially true of cyclones which are adapted to collection and classification of very fine to medium size solid particles in concentrations ranging from very low to medium as well as compressible, gelatinous, and amorphous materials that characteristically plug drainage media.

The basic distinction which is presented by the solids treated under gravity centrifugal separation or gravity centrifugal settling is whether the solids are fine or coarse, slow or fast draining. The compactness of all centrifugation equipment lends itself to low or medium tonnages where complete clarity of the liquid effluent is not required. This is ideal for coal washing.

CENTRIFUGAL SEPARATION

(a) Basic Apparatus Postulates for Theory of Operation of the Present Invention The following are the requirements for the apparatus of the present invention:

1. Crushed coal water is quick draining, noncompressible, nongelatinous, and does not plug draining media.
2. The ash and sulfur impurity has a different specific gravity than the main product and quantity of total ash or sulfur impurity is less than 50% with mineral ash less than 40%, this representing what is defined as a producible coal.

Figure 15:
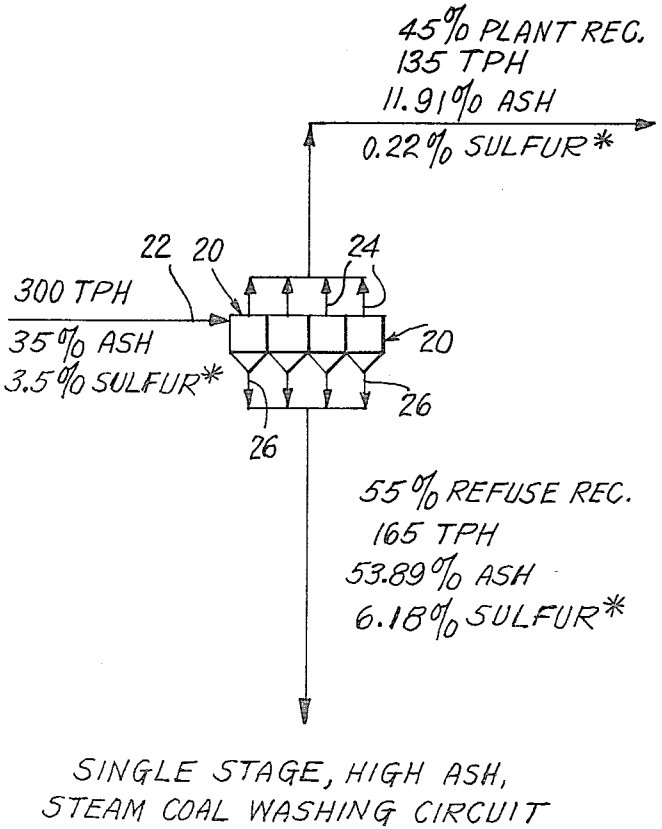
FIG. 15 is a diagrammatic view showing the results of a steam coal preparation having a single stage high ash coal washing circuit employing an inlet deflector and a shallow replaceable dish orifice unit.

I have discovered that the critical geometry, Table A, of a gravity separating shallow cyclone 20 having a conical bottom with bottom apex angles $\theta_4$ and $\theta_5$ of about 85° and 110°, preferably 100°±5° for an equivalent combined angle, is an essential factor which consistently and reproducibly predicts differences of separation, FIGS. 13 and 14, of impurity from the desired product and further predicts the recovery, FIG. 15, or desired product and further predicts the recovery or capacity, FIG. 15, of the cyclone 20 to predetermined the precise adjustments, FIG. 15, of the critical variables of the cyclone 20, which are shown in Table A. The above combined angle $\theta_4$ and $\theta_5$ of 100°±5° is $\theta_6$ in Table A.

(b) Function of Cyclone 20 Parts

1. The inlet (22) pipe deflector 23 means creating laminar or streamline flow directs the slurry along the bowl wall 28 of the cyclone 20 in a downwardly tangential helix with all particles layered by gravity from the inside wall 28 outwardly;
2. The vortex finder 44 sleeve 46, 146, 246 area based on the inner diameter D of the cylindrical structure 48, FIG. 4, which functions to withdraw lights above the shallow bottom 60, 60A, 70, 80 and 90;
3. The outlet orifice 64, 64A, 74, 84 and 94 diameter E which functions as a partial baffle or restrictor in its critical relation to the vortex finder 44 sleeve 46, 146, 246 area sizing to expand or to compress the number of helical turns, see FIG. 6, 170, in the tangentially streamline laminar flow and to further effect a smooth streamlined layered outflow of layered product through the vortex finder outlet pipe 44 above the vortex finder sleeve 46, 146, 246 from the bottom separation zone within the dish-orifice 60, 60A, 70, 80 and 90;
4. The spacing C of the vortex finder 44 sleeve 46, 146, 246 permits the smooth withdrawal of upward flow so that through the vortex finder 44 from the super gravity zone in the bottom cone 60, 60A, 70, 80 and 90, must be no more than 90% of the straight side wall height L of the cyclone 20 measured from the top edge of the cone 60, 60A, 70, 80 and 90 to the top 30 along inner wall 28 of the cyclone 20;
5. Pressure differential of at least 0.9 up to 1.8 preferably 1.5±0.2 atmospheres between the inlet tue 22 and the outlet pipe or vortex finder 44, the latter both being at atmospheric pressure thereby fixing the initial super gravity forces which maintain the essential separation between the vertical layers 1, 2, 3, 4 and 5 in FIGS. 3 and 5 in the straight side wall 28 section of the cyclone 20 and which maintain the high velocity momentum of the heavy particles in the conical bottom 60, 60A, 70, 80 and 90 departing from the restricted bottom orifice 64, 64A, 74, 84 and 94 to prevent undesired contamination of the light particles removed through the vortex finder 44. The high velocity momentum based on gravity, and the centrifugal velocity in the cyclone 20 and the abrupt change in direction at the bottom cone in 60, 60A, 70, 80 and 90 is sufficient under a $\Delta p$ of 1.5 atmospheres to completely overcome a tendency to wander from the outer conical wall in 60, 60A, 70, 80 and 90 zone towards the vacuuming zone within the vortex finder 44. See FIG. 3 for estimating short critical lateral cross-over distances.

(c) Preserving Streamline Flow

For sharp separation of different specific gravity materials in cyclone 20 apparatus a smooth streamline flow must be created at the entrance 22 when the material first enters the cyclone bowl 28; in order that smooth layers 1, 2, 3, 4 and 5 of different specific gravity particles will be created and aligned. The different specific gravity materials must be allowed to seek their respective layers 1, 2, 3, 4, and 5. Refer to Case No. 1, Ser. No. 860,330, for creating the layers 1, 2, 3, 4 and 5.

It is very critical that these layers 1, 2, 3, 4 and 5 are not destroyed until each one has departed from the cyclone bowl 28 and bottom unit 60, 60A, 70, 80 and 90. Prior art focused on separation within the bowl without considering the development of the reverse flow path and the effect this development had on each of the different specific gravity layers 1, 2, 3, 4 and 5 and the circular helical fluid velocity of 15 to 28 feet per second in the separating zone in 60, 60A, 70, 80 and 90 at the bottom conical portion of the cyclone bowl 28.

The laminar streamline flow develops two desirable situations.

The first creation of different specific gravity solid material layers 1, 2, 3, 4 and 5 lines up the materials swirling around the upper portion of the cyclone bowl 28 with the heaviest materials against the bowl wall 28 and the corresponding layers containing lighter materials as you travel away from the bowl wall 28 towards the vortex finder 44 wall. This alignment of materials sets the stage for the vacuuming operation. It is very critical that the solid particle helical 170 circular velocities be maintained while the particles are in the cyclone bowl 28 thus the reason for the squat cyclone to permit about 2 to 3 turns before entering the dish 62, 62A, 72, 82 and 92 zone. Once the light particles enter the vortex finder 44 sleeve 46, 146, 246 inner diameter D or the heavy particles enter the bottom orifice 64, 64A, 74, 84 and 94 inner diameter E, the helical 170 circular fluid velocities are no longer critical. Velocity may be radians per second (RadPS), rpm or Rps.

The quantity of material (pump slurry) being pumped for an 18" classifying cyclone 20 should be about 1500 GPM of 10 to 35% solid slurry. This flow quantity will yield the necessary entrance fluid velocity of from 15 to 28 feet per second for cyclones 20 equipped with the streamline flow deflector 23 to provide the centrifugal forces necessary in the dish 62, 62A, 72, 82 and 92 and orifice 64, 64A, 74, 84 and 94 separation zone with 60, 60A, 70, 80 and 90. See FIG. 3 for separation.

(d) Vacuuming Forces

The vacuuming forces are developed by the pressure differential between the inlet pipe 22 and the vortex finder 44 having an inner diameter D at the outlet 24. The pressure differential must be in the order of 0.9 l to 1.8 atmospheres to develop the vacuuming forces necessary to separate more efficiently the solid particle layers 1, 2, 3, 4 and 5 as they enter the separation zone within 60, 60A, 70, 80 and 90. The stage is now set for selective separation by particle specific gravity and not by particle size.

All particles must have enough helical circular 170 velocity momentum in order that the higher specific gravity particles will have enough centrifugal force at the correct RPM within 60, 60A, 70, 80 and 90 to overcome the vacuuming force in the separation zone within 60, 60A, 70, 80 and 90 and maintain their position in the outer heaviest particle layers 4 and 5 and report to the bottom orifice 64, 64A, 74, 84 and 94 outlet 26 and out of the cyclone 20. If the solid particles had not been layered according to particle specific gravity, it is possible for some of the heavier specific gravity particles to be vacuumed away up through outlet 24 with a large amount of the light specific gravity particles thus misplacing material, which does occur after considerable use of the cyclone 20 due to flow disturbances created by wear.

The amount of vacuuming desired depends on the percentage of recoverable light specific gravity particles being processed and the radians per second desired in the vacuuming zone within 60, 60A, 70, 80 and 90 which determines the specific gravity separation setting. The larger the percentage of recoverable light specific gravity particles, the larger the vacuuming area necessary to recover the particles. Vice versa for the smaller the percentage of recoverable light specific gravity particles, the smaller the vacuuming area. The vacuuming area is controlled by the inner diameter D and the length of about 0.3B minimum of the vortex finder 44 sleeve 46, 146, 246.

(e) Pressure Differential For Vacuuming Forces

The test runs using both laminar streamline flow and nonlaminar flow at flow rates between 800 and 1500 GPM produced a large difference of 7 psi in pressure differentials between inlet 22 and outlet 24 and a large observable circular helical 170 swirling fluid velocity difference. The pressure differential of 0.9 to 1.8 atmospheres was produced only when laminar streamline flow was used. The maximum pressure differential obtained without laminar streamline flow was 8 to 13 psi gauge. Very poor separation of low and high specific gravity particles was observed.

The poor separation without streamline flow was blamed more on not forming the different smooth layers 1, 2, 3, 4 and 5 than on the lower pressure differential. But it is obvious that when the centrifugal force of the particles is increased by the high circular helical 170 fluid velocities (15 to 28 feet per second) that a greater pressure differential will be required to vacuum the low specific gravity particles off the high specific gravity particles.

As the particles under angular acceleration with increasing angular velocity enter the separation zone within 60, 60A, 70, 80 and 90, the different specific gravity materials will have a wider range of vacuum resistance forces thus making the light specific gravity particles easy to vacuum compared to the higher specific gravity particles which are very difficult to vacuum at these centrifugal forces created by helical 170 swirling linear fluid velocities between 15 and 28 feet per second at the separation RadPS required within 60, 60A, 70, 80 and 90. See FIG. 6 for angular acceleration in terms of Rad PS.

At low circular helical 170 fluid velocities in the separation zone at the bottom conical portion within 60, 60A, 70, 80 and 90 of the cyclone 20, the vacuuming resistance forces of the light and heavy specific gravity particles have a much closer value thus both types of particles being predominant. This causes misplaced material and a low quality clean coal product. Also, some of the larger light specific gravity particles report to the bottom orifice 64, 64A, 74, 84 and 94 outlet 26 proven by refuse washability tests.

(f) Effect of Compression Before and Loss of Compression After

The larger observable circular helical 170 swirling fluid velocity difference was observed by the physical characterisitcs of the plant operating. With the nonlaminar flow a large amount of noise and plant vibrations were present. The cyclones themselves shook from flow resistance. When the flow was changed to laminar streamline flow, the speed of the material was such that the same bottom orifice used with the nonlaminar flow, producing 70% plant recovery for a two-stage circuit allowed about all of the raw coal to be discharged out through the bottom orifice. The bottom orifice was changed from a 0.236B"I.D. to a 0.208B" I.D. to yield the same 70% plant recovery. Obviously, the velocity through the cyclone was increased very significantly when using laminar streamline flow to empty the cyclone bowl 28 so fast when using the exact same bottom orifice. All noise and vibrations stopped when laminar streamline flow was used. The surprising discovery was that clean coal ash dropped from 18%–20% in turbulent flow down to 8–11% in streamline flow.

(g) Basic Theory Differences Between Centrifugal Separation and Jigging Separation

| Jigging Cyclone | Centrifugal Separation Cyclone 20 |
|---|---|
| (a) Low Velocity | (a) High Velocity |
| (b) High Kinetic Energy Due to Turbulence | (b) Substantially Zero Kinetic Energy Due to No Turbulence |
| (c) Low Potential Energy Due to Low Velocity and Low Pressure Differential as Indicated by Inlet Pipe Gauge 66 and Outlet Pipe Gauge 68 | (c) High Potential Energy Due to Pressure Differential Between Inlet 22 Pipe Gauge 66 and Light Fraction Outlet 24 Pipe Gauge 68 Which is .9 to 1.8 Atmospheres |
| (d) Very Low Super Gravity (.5 to 0.8 atmospheres) | (d) High Super Gravity Forces (.9 to 1.8 atmospheres) |

One Piece Shallow Bottom Dish-Orifice Unit of Erosion Resistant Material

A. Introduction

Although all cyclones are fitted with an orifice at the dish bottom whose diameter can be related to the cyclone bowl diameter, relatively few prior patents in the art of centrifugal separation teach replacement of the orifice element or teach an optimum relationship based upon added factors of clean coal quality and % recovery. Only Loughner, already mentioned, suggested changing the diameter but gave no advise on what values produce desired results.

Hirsch U.S. Pat. Nos. 2,975,896 and Fitch, Jr. et al. 3,501,014 mention desirable values of outlet orifice diameter which can be related to cyclone bowl diameter but Hirsch teaches a very long cone totally different from that of the inventor while Fitch, Jr. et al. mentions varying such parameters as bowl diameter, orifice diameter, inlet diameter and vortex finder diameter.

To facilitate understanding the invention with respect to the closest prior teachings in Fitch, Jr. et al. the comparison is made below:

| Fitch, Jr., et al. | The Present Invention |
|---|---|
| Regenerative Cyclone Do/Du | Decreased residence time with |
| Under Increased Residence time and Reduced Velocity in cone to Reduce Drag forces | Increased radial velocity in Conical portion. Increased drag forces |
| Inlet capacity | Inlet capacity |
| Cyclone 200 GPM | Cyclone 900 GPM |
| Col. 6, lines 10–18 particularly line 11 | Liller velocity six times greater than Fitch |
| Higher inlet velocities | |

Relationship of Orifice to V.F. Diameter in 12" Cyclone

| In Terms of B | | Ratio Do/Du* | | Ratio Do/Du |
|---|---|---|---|---|
| .25 | Do = 3" | 3 | .36 Do = 4.32 | 1.75 |
| .08 | Du = 1" Do−Du = 2 | | .21 Du = 2.4 Do−Du = 1.82 | |

o-orifice
u-cyclone cylinder portion

B. Wear of the Shallow Dish Unit

The most severe wear occurs in the throat Q of the orifice 62, 62A, 72, 82 and 92 and tapers out in both directions. For this reason the dish 64, 64A, 74, 84 and 94 and orifices 64, 64A, 74, 84 and 94 should not be separate parts. The separate dish 62, 62A, 72, 82 and 92 and orifice 64, 64A, 74, 84 and 94 metal parts showed severe wear at the mating surface. An orifice 64, 64A, 74, 84 and 94 and dish 62, 62A, 72, 82 and 92 designed and molded as one unit 60, 60a, 70, 80 and 90 is best.

A cast steel alloy known as "Ni Hard" forms the dish and orifice unit 60A in FIG. 6. The castings wore out after 3000 tons of coal processed. This casting contained 18% Cr, 89. Ni, up to 25% Cr and 12% Ni During the trial and error periods of production of about 100,000 tons changes in materials shown in FIGS. 3, 6, 9, 10, and 11 were tested and observations made with the object of reducing the wear pattern to produce and optimum design for reproduceability and increasing the quality of the coal being produced.

When the dish was made of Adiprene (FIG. 3) the single unit dish 60, and the orifice part 64 lasted about 5000 tons with no change in separation efficiency, e.g. with good reproducibility throughout its life.

The wear occurs evenly and smoothly and no gouging is observed causing flow irregularities. The curvature geometry remains constant. All radii from the bottom section at (65, 65A, 75, 85, and 95) of the orifice 64, 64A, 74, 84 and 94 (See FIGS. 3, 6, 9, 10 and 11) to the top M of the throat radius 12 change at a uniform rate thus maintaining the $\theta_9$ included angle and also maintaining about the 0.19B inch radius e.g., radius 12 from the $\theta_9$ included angle to the top M of the throat; this insures that there will be no change in coal quality as the orifice 64, 64A, 74, 84 and 94 sleeves wear out.

(C) Change in Percent Recovery During Wear

The greatest change in recovery, as predicted by the Cyclone Recovery Graph in FIG. 14, illustrates the effects of the diameter of vortex finder sleeve 46, 146, 246, size D, and orifice 64, 64A, 74, 84, 94, diameter E, in Table A versus cyclone top percent recovery (see FIGS. 12, 13 and 14) occuring between 0.20B and 0.23B the range of orifice diameter E. Between 0.20B and 0.22B of wear, the difference in wear represents $\frac{2}{3}$ of 0.03B, which is $\frac{2}{3}\times\frac{1}{2}''$, or $\frac{1}{3}''$ of wear in an 18" cyclone. As shown in FIG. 14, a decrease in wear of $\frac{1}{3}''$ results in about 6% change in recovery, e.g., a decrease which is surprisingly low. It was also discovered that wear between 0.22B and 0.23B, e.g., the last 2/9 of the wear, causes an 11% to 12% loss of recovery, shown in FIG. 14.

These surprising discoveries established that the orifice geometry (64, 64A, 74, 84 and 94) can be allowed to wear in a signicant manner to approximately the 0.22B diameter value, e.g., the value of E can change to a certain degree without substantially changing the plant percent of recovery. The cyclone plant used an Adiprene dish 62 and bottom orifice 64 in the total Adiprene unit 60, FIG. 3. A similar result of only 5% to 6% loss of recovery, when using other wear resistant materials with geometry monitored in precisely the same manner, was discerned.

(D) Wear Test Results for Adiprene Rubber Units 60 in FIG. 3

The different dish 62 and orifice 64 materials tested indicated that the Dupont Adiprene (polyether urethane L-100) 83 to 85 Durometer, Shore A, 60, FIG. 3, is the best rubber material. The following table shows typical test results.

TABLE B

| Rubber and Shore A Hardness | Number of Eight Hour Shifts of Satisfactory Wear |
|---|---|
| 1. Polyether Urethane Dupont Adiprene L-100 83 to 85 Durometer | 10 |
| 2. Polyester Urethane 90 Durometer | 3 |
| 3. Polyester Urethane 80 D | 8 |
| 4. Polyester Urethane 90 D, 95 D Dupont Adiprene L-100 | 1 |

In Table B increasing the hardness of the urethane rubber reduces the wear resistance. The best hardness is 83 to 85.

Lowering the harness to about 70 Durometer Shore A is totally unsatisfactory and causes both a loss of tear strength and of toughness.

Applicant has also found that American Cyanimide Co. produces a urethane material similar to Dupont's Adiprene which wears as well as the sample Trial No. 1.

(E) Hard Alloy Materials for Dish 62A and Orifice 64A

The preferred non-rubbery material for the dish 62A and orifice 64A is a hard metal alloy such as tungsten molybdenum carbide alloy, chromium carbide alloy or a tungsten-chromium titanium carbide alloy. The foregoing alloys may be modified with cobalt. An outer holder of steel 80, FIG. 10 and a liner 86, FIG. 10.

Another preferred wear resistant alloy is a mixture of 5% fine grain tungsten chloride and 95% coarse grain tungsten carbide alloy which is stabilized with a small amount (0.1 to 0.2) of vanadium carbide and hardened with about 0.2% chromium. This is the preferred wear resistant alloy used in FIGS. 6 and 10 for parts 60A and 80. Another preferred alloy is the foregoing tungsten carbide alloy with vanadium carbide alloy to which is added about 6% to 15% of cobalt for increased ductility. Fabrication of this alloy is made in accordance with the specifications given in the Handbook of Hard Metals by W. Dawihl, copyrighted 1955 by Her Majesties Printing Office in Great Britian.

Ceramics as set out in Section (F) below can also be used as the wear resistant material for 70, 80 and 90 in FIGS. 9, 10 and 11.

(F) Ceramic Composition of Dish in FIGS. 9, 10 and 11

A magnesia spinel (formula $MgAl_2O_4$) is a preferred ceramic which can be made by the technique as used in manufacturing the lining for a molten steel crucible by using a parting agent and making a slip in a mold (plaster of Paris) in the shape of the liner 76 and 86. The dish must be fired at high temperatures to convert it to magnesia spinel.

Another ceramic which can be used is a cast and fired ball mill lining composition based on aluminum for the dish and orifice units 70 and 80, FIGS. 9 and 10. The $Al_2O_3$ composition of British Pat. No. 454,946 of Apr. 4, 1935 is made as shown in these patents. Another unit 90, FIG. 11, made entirely of $Al_2O_3$ composition is also used.

(G) Effect of % Solids, Particle Size, Fracturability, Raw Coal Feed Velocity, Mineral Ash Content and Inorganic Sulfur Content on the Wear of the Dish 62 and Orifice 64.

All observations below based upon per ton raw coal washed.

1. Surprisingly, cutting the percentage of solids from 20% to 15% increased wear at velocities of 15 to 24 feet per second which are optimal for best washing. A dish-orifice unit 60 at 13% to 15% solids is replaced every 5,000 tons. Accordingly, a complete study that wear went from a maximum to a minimum starting at about 17% and rising only slowly to 30%. There are at least three factors at play, the cushioning effect starting at about 17%, the water saving effect which increases rapidly between 20% and 30% and the rapidly rising energy requirement for pumping such thicker slurries. With a given low cost pump which is relatively low cost because of its use of a lower horse power electric motor for pumping, the pumping limit governs the cost of the installation. No pump can be used for more than about 80,000 to 100,000 tons without rebuilding or replacing the impeller and housing which are known to wear out quickly.

The optimum solids pumped at low cost is between 18% and 25% and best results were found at 19% raw coal solids in the slurry ($\frac{3}{4}\times 0$). The pump was used for 100,000 tons. The pump was a $10\times 8$ low cost Allis Chalmers centrifugal impeller group with 100 HP rating.

At a pump cost three times greater, an iron ore slurry pump can be used and this lasted a much longer time. The dish-orifice unit 60 which was used with the slurry at about 17% to 20% solids was replaced after 9,000 tons were processed.

(a) Particle Size for Most Efficient Washing

Lowest wear is at particle range $\frac{1}{2}\times 0$. At $1\frac{1}{4}\times 0$, gouging out of the rubber lining was observed by the large particles. As the particle size was reduced to $\frac{3}{4}\times 0$, the gouging disappeared and the wear zone was more uniform in appearance and resembled a sand blasted area confined in the dish-orifice unit 60 with the most severe wear occurring in the dish 62 and orifice 64 throat Q, tapering off to a no-wear zone in the cylindrical portion of the orifice 65. No observable wear occurs at the upper lip of the dish 62.

Equally important to efficiency of operation and quality of clean coal is fracturability, sulfur content and ash content of the coal. To properly understand wear, keeping in mind adjustments for fracturability of particle size for high mineral ash content and high inorganic sulfur content, attention to Table A, Section II, is invited.

With all parts in best adjustment and the vortex finder above the 0.00 top edge limit identified in the Table, which is above the top edge of the dish at 0.23 B, and with optimum diameters for sleeve D set at 0.36 B, orifice E set at 0.21 B, in an 18" cyclone, and with dish orifice unit of height H set at 0.69 B, wear is monitored at three critical dimensions, as follows:

| Letter | Part | Value |
|---|---|---|
| M | Throat diameter of orifice | .39B |
| E | Smallest inside diameter of orifice | .21B |
| $\theta_9$ | Included angle of orifice between radius 12 and smallest inside diameter E | 12° |

Wearing away of the cyclone parts at the above specified dimensions and identified in Table A contributes the greatest change in percent of recovery and clean coal quality due solely to wear.

Due to the difficulty of directly monitoring $\theta_9$ and M, the change in E, described in (C) above, is sufficient to reproducibly predict the outside limits of wear which control the efficiency of performance of the cyclone. Thus, subsection (C) above establishes confidence limits of the order of 5% to 6% in projecting wear data with respect to $\theta_9$ to M. Further, a projection "along the way" can be made because the last $\frac{1}{3}$ of wear does greater damage to the maximum performance, which is set at "no wear".

IV.

Quick Change Vortex Finder Sleeve Kit For Maximum Quality and Recovery of Clean Coal (A) Introduction Each of FIGS. 3, 4, 6, 7, and 8 show different diameter settings of the vortex finder sleeve; the change in diameter D is facilitated by the quick change plate 32 and pivotable fixture bolt 38' which drops the dish. Different dish-orifices 60, **60*a*, 70, 80 or 90 can each be quickly checked after being dropped and pivoted for wear and then exchanged if need be at the same time when changing the vortex finder sleeves 46, 146, or 246** to the desired setting.

Streamline non-turbulent flow must be maintained (see Case I) in order for high production and efficiency to be achieved in a single, a two stage, or a multi-stage operation beyond two stages. To ensure efficient operation the vortex finder 44 settings, and selection of the dish-orifice 60, 60*a*, 70, 80 or 90 materials are adjusted to the wear conditions encountered and these must all be handled quickly by means of the quick change plate 32, the fixture bolt 38' and the fasteners 38.

In the fine and coarse coal separation of Case I–IV, Ser. No. 973,408, the most serious problems which were encountered were the quick change steps to maintain high production and efficiency. These changes were specifically:

1. Quick change of diameter settings of vortex finder 44
2. Replacement of different size or worn dishes An additional problem encountered during the test runs was the optimum vortex finder depth setting. Different raw coals vary in grindability or fracturability as illustrated in Table D, section 6. The crushed particles of dirt and clean coal from easily fracturing coal display large differences between coal and refuse in specific gravities of the order of .9 sp. gr. and larger. The more difficult fracturing raw coals produce particles of dirt, low grade middling coals, and clean coals. The middling coals which contain inorganic sulfurs, shales, clays, and other impurities have specific gravities in the range of 1.4 to 1.7. These narrow differences in sp. gr. of about 0.3 units are accounted for by the clinging concentration of impurities which do not separate from the clean coal in the coal particle.

The middling coals create the need for a very selective separation process. By very laborius and time consuming testing the importance of the heavy particle spin out was discovered and controlled by the depth of the vortex finder sleeve 46, 146 or 246 bottom edge with respect to the top edge of the dish 60, 62*a*, 70, 80 or 90.

(B) Criticality of Vortex Finder Height

My first tests in attempting to fix the vortex finder height indicated that the inner swirling upwardly moving clean coal slurry picks up some heavy specific gravity particles which then spin back out of the upwardly moving spiral (the inner spiral) and into the downwardly moving spiral (the outward spiral) surrounding the inner swirling upwardly moving spiral path which contains the clean coal. The vortex finder height was changed from a negative value (indicating protrusion into the dish) in a series of trial and error steps to a value that no longer yielded a better quality clean coal. At the value of 0.24 B above the dish edge the maximum improvement in coal quality was discovered. Adjusting the height dimension to a greater value than 0.25 B increased the path of travel of the clean coal particles thus requiring more energy to maintain the vacuuming area and the centrifugal forces necessary to produce efficient separation.

Adjusting the height dimension to a smaller value than 0.22 B cut short the heavy specific gravity particle spin out path before the particle had spun to the downwardly moving outer swirling flow thus misplacing the heavy specific gravity particle with the clean coal, thus producing lower quality clean coal. Thus, the height range is 0.22 B to 0.25 B, preferably 0.23 B for optimum performance.

(C) Vortex Finder Sleeve Kit

The vortex finder sleeve kit shown in FIGS. 2, 3, 4, 6 7 and 8 is used to control recovery and improve quality. The height of the vortex finder in relation to the top edge of the dish is set at about 0.23 B as pointed out above. The diameter of the vortex finder sleeve is set at about 0.3 B to 0.5 B depending on quality and quantity of clean coal desired. The length of the sleeve 46, 146, 246 in FIGS. 2, 3, 4, 6, 7 and 8 is at least about 0.33 B and is fixed for all sizes because the length serves to stabilize the edges in the vacuum zone.

(D) Vacuuming Diameter and Column

The length of the vortex finder sleeve fixed at 0.33 B and height setting of the vortex finder sleeve fixed at 0.2 B determine the reverse flow path and the distance that the light sp. gr. particles must travel before exiting out through the sleeve. A length of vortex finder sleeve greater than 0.5 B is cumbersome to handle and weld and wasteful of material. The length of the vortex finder sleeve stabilizes the vertical whirling ascending spiral in a fashion to shape it in a constant three dimensional form which is similar to a bell in shape. The diameter of the vortex finder sleeve determines the bottom vacuuming diameter and column of the bell shaped vortical form.

The larger the bottom vacuuming diameter of the bell shaped spiral then the lower the centrifugal force of each particle entering that larger diameter of the bell shaped form. The smaller the bottom vacuuming diameter of the bell shaped vortical the higher the centrifugal force of each particle entering that diameter.

In the dish zone the particles swirling down through the cyclone dish and bottom orifice experience about a three-fold increase in Rad PS between the dish top edge and the throat top M of the dish 62, 62*a*, 72, 82 or 92 in FIGS. 3, 6 and 9–11. This angular acceleration increases the centrifugal force on the particles as they travel along the inner surface of the dish and orifice.

(E) Optimum Centrifugal Force

By empirical testing the optimum centrifugal force for separating light sp. gr. particles from heavy sp. gr. particles for different run of the mine raw coals and gob piles have been determined indirectly through the sizing of the vortex finder sleeve diameter with respect to the percent recovery, raw coal ash content, clean coal ash content and the size of the bottom orifice diameter which expands or contracts "the lead of the screw," e.g., the swirling flow which presents a screw flight pathway within the dish and orifice unit.

The larger the vortex finder sleeve diameter, the lower the centrifugal force displayed by each particle as it enters the larger vacuuming area created by the vortex finder sleeve diameter D. This yields high recoveries with lower quality clean coal.

(f) Method Of Changing Vortex Finder Sleeve Kit From One Diameter To Another

The types of sleeve kits are shown in FIGS. 4, 7 and 8. The different size diameter sleeves 46, 146 and 246 are made up from "donuts" cut from steel plate. "Donuts" of different inner diameter are used for insertion of corresponding size sleeves with the sleeve being welded to the "donut". The sleeves have a minimum length of about 0.3 B and are made from tubing which is mechanically drawn over a mandrel. Different diameter sleeve kits are shown in FIGS. 2, 3, 4, 5, 7 and 8.

Two types of sleeves can be produced. One, shown in FIG. 4, is a quick-change sleeve 46 with bayonet attachment of the type shown in U.S. Pat. Nos. 795,338 and 1,329,141. The second is the tack and stitch weld attachment sleeve 146 and 246 shown in FIGS. 7 and 8.

In a small cyclone, the tack and stitch weld 152 or 252 can be made through the bottom of the cyclone despite access difficulty by the mirror weld method. This tack and stitch method requires attaching vortex finder sleeves 146 or 246 from the bottom by means of a mirror to aid the welder visually as he tack welds the sleeve in place. This prevents the welder from exposing his body to the hot slag and sparks falling from the welding. Only three stitches or tacks 152 or 252, approximately ½" to ¾" long and equally spaced around the periphery of the vortex finder 144 or 244 and ring 150 or 250, as shown in FIGS. 7 and 8, are required.

Due to the longer change time required for the tack and stitch welding method, bayonet quick-change sleeve 46 is the preferred kit. The plant is able to continue operation with the bayonet modification under any emergency. However, the change sleeves in FIGS. 7 and 8 can be made up in advance, or lower in cost, and can be used when large tonnage of a straight run of mine coal is to be washed. The steel sleeves last for at least 30,000 tons and change is a minor operation during routine maintenance.

V.

Critical Geometry of One Piece Shallow Bottom Dish-Orifice Unit

(a) Relation of Dish-Orifice Unit Depth L To Bowl Diameter B and to Total Bowl Height K As shown in Table A Section II, the optimum value dish orifice unit depth L expressed in terms of bowl diameter B is about 0.93 B, about 17/18 of the bowl diameter. If the depth L is less than about 14/18, e.g. about 0.78 B then the dish is so shallow as to cut the number of helical turns 170 by about 40% which results in a totally insufficient separation because of a prohibitive reduction of residence time. Further, the upward adjustment of the vortex finder sleeve which is needed to maintain vacuuming dynamics comes dangerously close to the inlet tube level thereby creating the condition which Fitch Jr., et al. claims in U.S. Pat. No. 3,501,014 at Col. 6, lines 59–60 the "short circuit effect" by "contaminants from the inlet to the vortex finder" At L values higher than B, the path 170 in FIG. 6 becomes too long losing energy and separation efficiency. Accordingly, the range of L is 0.82 to B with optimum at 0.93 B.

In terms of K, the value of L can best be explained in terms of the effect observed with the path 170 in FIG. 6. Obviously, the deflector created streamline flow providing the three turns of the helical path is clearly dependent upon the total height—e.g. K. By lengthening K to add two or three turns in the upper bowl section above the dish we obviously lose energy. After thousands of observations it was established that two turns are insufficient for separation and more than four turns are wasteful of centrifugal energy which is the sole force used in separation. This results in a K value between 1.12 B to 1.32 B, preferably 1.22 B. Obviously this describes a squat cyclone.

(b) Dish and Orifice Geometry, Vortex Finder Sleeve Area and Orifice Outlet Area For high speed laminar flow squat cyclones no tight or fast turns in flow direction can be applied to the slurry path yet the path of travel must be a minimum, See FIG. 6. The circular diameter of the swirling flow must be decreased as rapidly as possible without loss of energy, or without turbulance being introduced. Smooth transition curves must be used between included angle changes in geometry, See Table A. Tests to date, indicate that a maximum included angle of 110° is the largest useable dish angle for best separation efficiency. The long cone cyclones experience too great a loss in rotational energy to yield the energy necessary in the separation zone and in the inner upwardly traveling vortical swirl for maximum efficiency. The path distance for particles in a long cone cyclone is at least 3 to 1 compared to the path distance in the cyclone of the invention which indicates a need for three times the energy requirement or only ⅓ the energy is available for the separation process.

(c) Identification of Dish Top Angles In Dish Types

The double or single top angles of the dish, indicated by $\theta_4$ and $\theta_5$ (for the double angle), or by $\theta_6$ (only in the single angle) See FIGS. 9, 10 and 11 provides the first compression rotational acceleration increasing the centrifugal force on each particle.

The spiral path through angle $\theta_5$ continues the speed up process to increase angular velocity accelerating the rotation expressed in RAdP.S. two to three fold. Acceleration of the vertical downward velocity without substantially lessening the kinetic energy and horizontal velocity component results in an increase of the exiting velocity of the refuse from the dish out of the orifice 64*a* in FIG. 6, where it enters into the top part of the orifice. The separation zone is at the throat of 64 where the height of radius 12 in FIG. 6 is less than one complete spiral height. This fixes separation at the position of the accelerated spiral 170, FIG. 6 at the smallest diameter of the cyclone radius 12 connecting the dish to the orifice.

As shown in FIG. 6, the helix 170 expands at its bottom to increase in height so that in the orifice the helix 170 stretches to occupy the entire throat height T (See Table A) during one revolution. This finish point of this one turn brings refuse to a position at the back of the orifice throat.

The smaller the vortex finder sleeve diameter, the higher the centrifugal force as the particle enters the smaller vacuuming area and lower recoveries with better quality clean coal results.

It is totally unexpected that a shallow dish whose accelerating effect on the downward velocity component exhibits a stabilizing effect on the upward reverse vortical flow of the light particles under vacuuming forces. Stabilization by means of the vortex finder sleeve height 0.033 B axially aligns the ascending vortical whirling helix transport light particles along the central axis of the cyclone, and out of the clean coal outlet.

After testing every possible position of the vortex finder in and out of the dish and at the extreme top position in scores of plant runs and in combination with every variation of vortex finder diameter D and orifice diameter E and dish exit diameter M it was discovered that only the critical shallow dimensions in Table A coupled with the vortex finder D dimension constitute the required adjustments for sulphur and ash removal of raw crushed coal. Equally surprising is the discovery that the practical washing of coal having 45 to 50% of ash in a size as large as $\frac{3}{4}\times 0$ can be carried out successfully based upon this adjustment. Although it is preferable to use smaller crushed sizes e.g. $\frac{5}{8}\times 0$ or $\frac{1}{2}\times 0$, the adaptability of the invention extends to larger sizes for which there is a greater demand for fluidized bed in gas conversion processes.

(d) Bottom Orifice Outlet Diameter E (See Table A)

The existing refuse slurry coming out of the orifice 65*a* makes an angle of approximately 30° from the horizontal on the right side of the orifice and approximately 45° angle on the left side of the orifice with a left hand spiral within the cyclone. By knowing the lead of the spiral 170 which is controlled by the bottom orifice outlet 65*a* diameter E, it is possible to determine the path 170 of each particle.

(e) Stages of Separation Double Top Angle Dish-Orifice FIGS. 3, 6 and 9

The reduction in diameter within the dish from top to bottom is in a ratio of about 3 to 1. This reduction occurs in a squat cyclone as defined under (a) above having approximately the same height of cylindrical portion as diameter (range of 0.82 to 1.0 of the L/B).

The preferred shortest vertical component of the short path distance is about 0.66 B e.g. $\frac{2}{3}$ of diameter B of the cyclone. Obviously the descending spiral path 170 provides a longer distance which can be calculated but is not necessary because the spiral path which is exclusively controlled by the velocity component of the incoming stream and the inlet deflector angle in my copending application Ser. No. 860,330, defines the entrance geometry at the dish e.g. cyclone cylinder parting line and the initial slurry compression by the downward spiral path 170 accompanied by change in spiral path. The transition must be smooth and the change in the inward direction must be gradual since heavy particles in the outer path are at their maximum velocity and it is essential that they maintain their outer position.

The heavy particle travels about 1/10 to $\frac{1}{8}$ of the diameter and 1/7 of it's downward path to lie within an included angle of about 85° at the end of this $\frac{1}{8}$ distance thereby assuring that there is no changes in lanes as the next or second stage of travel by the heavy particles is entered.

In the second stage representing an additional vertical depth of about 1/7 of the total depth, the heavy particles undergo gradually increasing rate of centrifugal force by an increased spiral velocity in RPM due to the reducing dish diameter. In this second stage where the spiral travels an additional 1/5 of the vertical distance of the total depth of underflow, the gradual change in angle at the lowest point by the second stage reaches about 110°.

Effectively the first stage is a guidance stage of the compound curvature effecting initial gradual passage into the underflow under the angle of 85° for a travel of about 1/5 of the underflow depth. The second stage is an accelerator guidance stage for an additional vertical distance increase of the spiral of 1/7 of the diameter and an added 1/5 of the depth thereby permitting the final or thrid stage of passage for the spiral at the orifice 64*a*, FIG. 6.

In the third stage the spiral has diverging paths in about $\frac{3}{8}$ of the depth to traverse rapidly it would be expected that best results would be achieved by still maintaining this gradual change, however, as pointed out above, the diameter at the second stage exit is about $\frac{3}{8}$ of the diameter of the dish and it is essential that a final orifice diameter of 1/5 of the dish be attained, which requires that the diameter be cut by about half.

Rather than extending the diameter reduction through the remaining $\frac{5}{8}$ of the height of the outflow path, the inventor has found it to be essential to create about 100° reduction in the included angle at the throat entering the orifice in a portion of the total underflow height of about 1/5th.

The spiral path, which leaves the critical throat zone of compound curvature of the orifice 64*a*, FIG. 6, has a cylindrical straight outlet portion (10° to 15° included angle taper) of the orifice which is about only 36% of the underflow thereby leaving about $\frac{1}{3}$ of the last stage path of about $\frac{1}{2}$ of the total underflow.

The 100° change in included angle between $\theta_5$ or $\theta_6$ and $\theta_9$, FIGS. 9, 10 and 11, which is so critical and is mentioned above was determined after production and testing about 15 to 20 test runs of about 6,000 to 8,000 tons each and after painstaking examination of wear patterns on various impact resistant dishes and orifices followed by confirming operational analysis and computer analysis.

The total tonnage which has been run to date and which confirm the above observations is about $\frac{1}{4}$ million tons and the coal samples have undivided waste coal (gob pile), met coal, steam coal, and sub-bituminous coals. It's expected that by year end the total tonnage will be above $\frac{1}{4}$ million.

(e) Separation in Single Top Angle Dish Of FIGS. 10 and 11

More specifically, the unit has five distinct zones. The top entrance zone has a $\frac{1}{8}$ inch wide top radius lip that contacts the bowl wall and directs the swirling flow from a zero included angle through an 80° included angle change, to a 100° included angle making one continuously straight cone surface along a center line distance of 0.23 B. At this depth the swirling flow is directed, by a 0.194 B radius 12 along the smooth surface through another continuously changing angle reducing to 100° included angle to a 12° included angle via a center line distance of 0.14 B. The swirling slurry is at a depth of 0.38 B as it begins its path along the conical surface which forms the $\theta_9$ included angle along a center line path of 0.25 B. The total depth of the dish and orifice unit at the bottom of $\theta_9$ included angle surface is .63 B. At this depth the swirling flow is directed through the last included angle change of about 12°. The swirling flow diameter has been reduced from B diameter to about 0.20 B diameter in a center line distance of 0.63 B. The 0.06 B center line distance the flow travels in its last straight walled cylinder yields a slower wearing diameter E thus reducing the rate of change of the smallest diameter at the end of the unit.

The above geometry is used for the ceramic ($Al_2O_3$) dish and orifice unit 92, FIG. 11, to minimize manufacturing cost. The important geometry is that of reducing the diameters at a set rate in the different zones of the unit to preserve smooth streamline laminar flow. The first diameter reduction via a straight walled cone from B to 0.39 B along the center line distance of 0.24 B is maintained. The remainder of the unit is identical to the other one and two piece units tested.

The aluminum oxide ($Al_2O_3$) dish and orifice unit can be substituted for the urethane and other wear resistant dish and orifice units to take advantage of the wear characteristics of ($Al_2O_3$). All of the different material dish and orifice units will perform well on all slurries, but with different rates of wear. The selection of different materials for the dish and orifice unit makes available parts of different costs to satisfy any policy on inventory.

VI.

Raw Coal Particle Size, Mineral Impurity Hardness and Effect on Recovery

(A) Crushed Raw Coal Particle Size

It is known that mined coal must be crushed for liberation of mineral ash, inorganic sulfur, and other coal impurities. Cleaning differences were observed in raw coals of different fracturability crushed to the same size and having the same raw percent of ash and sulfur, yet processed with the same plant settings. Raw coals producing the heaviest load on the plant sizing screens and requiring maximum energy for crushing the coal by the coal crusher yielded the poorest quality clean product. It was further discovered that harder coals required smaller sizings, e.g., lower particle sizes, to yield the product that softer raw coals produced, the optimum size being $\frac{1}{2}''\times 0$. Softer coals do not overload the screen and crushers and the refuse is different from that of harder coals. The settings are shown in FIGS. 12, 13 and 14 illustrating the different values required for harder coals and for softer coals for $\frac{3}{4}\times 0$ coal size.

(B) The Influence of Primary Mineral Impurities in Crushed Coal on Washing Efficiency (1) High Ash in Hard Coal—Identification by Mineral Hardness on Moh's Scale and Upper Freeport Seam The optimum size in the invention at $\frac{1}{2}\times 0$ for hard coal can be extrapolated from FIGS. 12, 13 and 14 and it is only necessary to use the "top coal", first stage curve in FIG. 12.

The primary hard minerals associated with coal are quartz (hardness, H7), garnet (H7–7.5), topaz (H8), tourmaline (H7–7.5), ziron (H7.5), augite (H5–6), and rutile (H6–6.5). These give problems during grinding of the coal. The principal materials of coal such as vitrinite, exinite, fusinite, and inertinite are easily fractured. However, the presence of 15 to 25% mineral ash makes certain coals very difficult to fracture. An example is in the Upper Freeport Seam. It is not the quantity of the ash but the quality of the ash which governs fracturability. Coal from the Upper Freeport Seam taken below the Big Joe binder is very difficult to grind. The grindability on the hardgroove grindability index is about 80.6 which represents a much less fracturable coal than the standard. The Big Joe bottom coal had an ash of about 22 to 30% in the run of the mine. The seam is shown below.

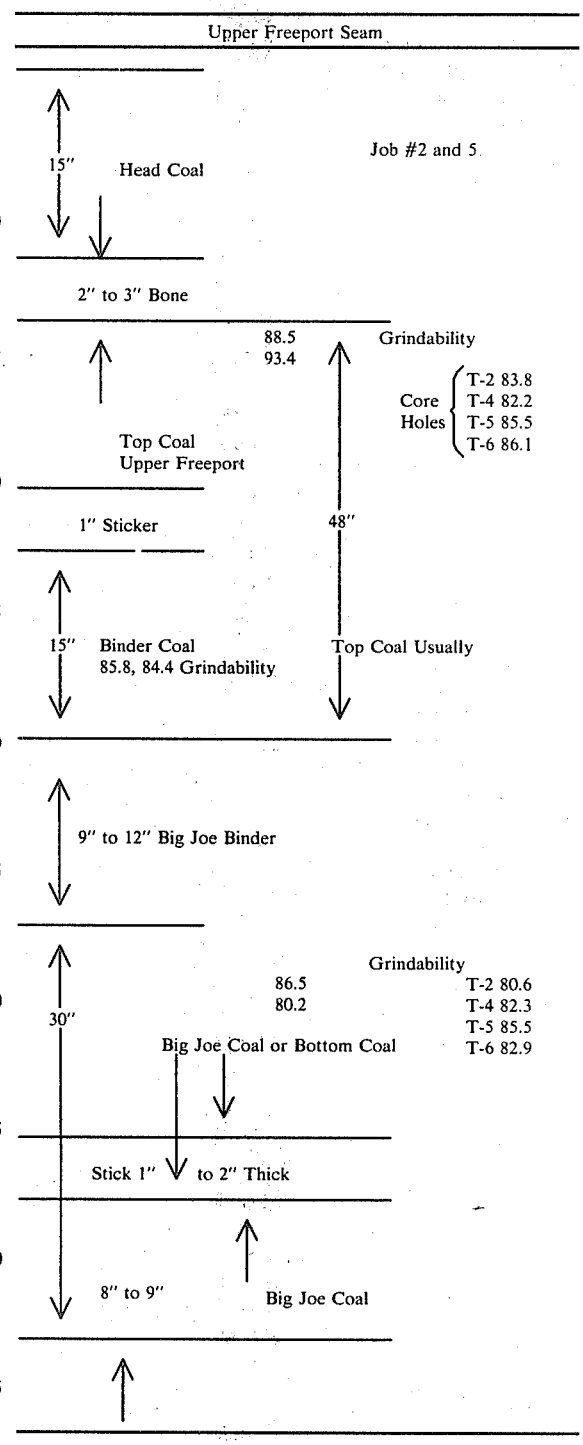

(2) High Ash in Soft Coal and Gob Pile, Georges Creek

Another example of Gob pile coal from Georges Creek, Lonaconing, Maryland which is low in sulfur and was believed to be unwashable for about 100 years has an ash content of 25 to 40% with a sulfur of 0.70 was the most friable and easily fractured material of high ash content which the inventor has ever handled.

In the 3 cyclone preparation plant, the inventor could grind and wash 150 TPH of Gob pile but with difficulty and great care could wash only 90 TPH of Big Joe bottom coal due to overloading the sizing circuit of the plant. Accordingly the maintenance of highest standards for production of clean coal quality at minimal plant investment requires careful attention to the fracturability of the coal being washed. Obviously, a more expensive crusher adapted to fracture harder materials can be used but this would increase the cost of the plant.

(C) High Inorganic Sulfur, Wheelock Recommendations

In the ACS Symposium Series of Coal Desulfurization Chemical and Physical Methods, by Thomas D. Wheelock, copyright 1977, it is stated, at page 37, that "removing sulfur from coal requires reducing the particle size of the coal prior to direct physical separation with water washing". The author of this section, J. A. Cavallaro et al described crushing (Lower Freeport Bed Coal and Pittsburgh Bed Coal) to 200 mesh, both samples being taken from mines in West Virginia. The Lower Freeport Bed sample gave maximum reduction in pyritic sulfur for the 14 mesh (about ¼") fraction. It is of interest to note that the Lower Freeport sample is similar to the Upper Freeport Seam tested by the inventor and sulfur content is comparable. The Pittsburgh bed gave maximum sulfur reduction at 48 mesh. Grinding the Lower Freeport sample down to 200 mesh gave little improvement. Grinding the Pittsburgh sample from 48 mesh to 200 mesh gave little improvement.

In contrast to Wheelock, the present invention uses much coarser particle sizes. Some coals are cleaned at $1\frac{3}{4}\times 0$ and cleaning is even better at $\frac{3}{4}\times 0$. The best quality is in the particle size range of $\frac{1}{2}\times 0$ so that all coals can be washed and down time for changing size can be avoided.

Below the inventor proposes a relative fracturability index at a scale from 0 to 10. 100 is the grindability of coal from the Jerome Mines, Upper Kittaning Bed. This 100 value is assigned a relative fracturability index of 0 in the inventor's index, see Table C below.

TABLE C

Relative Fracturability Table

| Relative Fracturability | Hardgrove Grindability |
|---|---|
| 1 | 97½ |
| 2 | 95 |
| 4 | 90 |
| 6 | 85 |
| 8 | 80 |
| 10 | 75 |

(D) Sulfur Removal in Presence of Clay

If the particles are very large so that the heavies are not exposed as separable particles, then coarser particles can contain washable coal and may be lost. These coarse particles must be reground to finer size and rewashed.

After washing several dozen different types of coal of different grindabilities containing high sulfur and difficult to remove clays, it was found that it is not economical to wash below 5% mineral ash (on a dry basis) and that it is not possible to wash out organic sulfur with water only.

The same experience is found in larger scale plants such as the jigging cyclone plant installed by McNally Pittsburgh at Wilson, Maryland. The coal for jig washing is at a size of $\frac{3}{8}\times 0$ in order to get the practical low particle size for sulfur removal.

(E) Fracturability of Raw Coal in Terms of Hardgrove Index

The grindability of a coal is a measure of ease of pulverizing that coal compared to the ease of pulverizing of a standard coal that has been assigned a Hardgrove Index of 100. The standard coal is a low-volative coal such as that from the Jerome Mines, Upper Kittanning Bed, Somerset County, Pennsylvania. Thus a coal with a grindability of 125 could be pulverized more easily than the standard while a coal with a grindability of 70 would be more difficult to grind. The Hardgrove Index is defined in Chemical Engineers' Handbook, 5th Ed., pgs 8–8 and 8–52.

(3) Correlation in FIG. 12 between Ease of Fracturing and Quality of Clean Coal Produced Reference is made to FIG. 12 wherein the curve for "Big Joe Coal" takes into account fracturability by crushing raw coal to a size of $\frac{3}{4}\times 0$ in the cyclone washing plant of the present invention in the 18" cyclone. FIG. 12 shows the percent of ash removal in a range of 10% ash to 100% ash removal on the x axis and the percent top recovery on the y axis. Comparing Big Joe and Top Coal in the two curves of FIG. 12 gives the difference in percent recovery based on fracturability.

(F) Screening followed by Crushing (Rotary Breaker) and Second Screening and Crushing Steps Incoming coal is first screened in a primary screen before passing through the rotary breaker. A secondary screen using about ½" square screen cloth is then used to screen the coal from the breaker and primary screen to constitute the raw coal feed before it enters the first stage slurry tank.

The primary screen and rotary breaker are equipped with 1½ screen cloths which results in the feed into the breaker being broken into sizes of 1½" minus. All lumps that do not break while in the rotary breaker are discharged to a refuse pile. All lumps that break into sizes of 1½" minus are circulated into the other 1½" minus size circuit from the primary screen and are fed to the secondary screen where all the feed is then sized into two fractions.

One fraction passes through the ½" square screen cloth and is discharged into the first stage slurry tank. The other fraction is fed into the coal crusher where it will be crushed to size and recirculated back across the secondary screen to insure that any oversize particles are not discharged into the first stage slurry tank.

VII.

Examples of Critical Location of Cyclone Parts

(A) Wear in Cyclone Head Space FIGS. 3 & 6, 7 & 8 Between Plate 30 and Inlet 22

The inventor has found that any space between plate 30 and inlet 22 within the cyclone bowl 28 is a very abrasive zone. This suggests disrupting unstreamlined flow and for this reason an abrasive resistant spacer plate 30 is fitted to the top cover plate 29 of the cyclone 20 to fill this void. The inlet 22 can be raised to the top for cast cyclone 20 inlets 22 and top portions that do not represent any undo manufacturing difficulties.

(B) Criticality of Cyclone Height L

As mentioned in Section V, the energy in the inner swirling upwardly moving spiral flow derives from the amount of energy contained by the downwardly outer moving swirl at the separating zone within unit 60, 60*a*, 70, 80 or 90 downwardly outer swirl has a greater distance of travel, the energy loss proportional to distance, reduces the centrifugal energy upon entering the separation zone and the inner upwardly moving swirl has less energy.

(C) Example of Plant Settings (1) Two Stage Washing

If it is desirous to clean 13% ash raw coal of a suitable fracturability to produce met coal of 8% ash or less and 1.15 or less % sulphur, it would require a two stage plant setting of 661/2% cyclone top % recovery in the first stage, See FIG. 12, and a 43% cyclone top % recovery in the second stage, reference to FIG. 12. This would yield an 81% plant recovery of met coal.

A 0.347B" diameter D vortex finder sleeve 46, 146, or 246 coupled with the 0.205B" inside diameter E orifice containing the $\theta_9$ included angle and the 0.194B radius connecting throat top M to $\theta_9$ installed in the first and second stage will yield the above setting. Now the cyclone top % recovery will slowly drop off as the 0.205B diameter E is worn out to 0.222B".

At a 0.222B" diameter E the cyclone top % recovery for the coal described and the 0.347B" diameter D vortex finder sleeve, 46, 146 and 246, would be 50% for the first stage and 26% for the second stage yielding an overall plant % recovery of 63% thus a loss of 17% misplaced material. The 63% recovery will still meet met specifications but the 17% loss will warrant new orifices.

The amount of wear tolerated will depend on the coal being processed. As an example a new set of orifices 64, 64*a*, 74, 84 and 94 could be used for producing a high recovery rate for say met or steam coal from a specific raw coal and then when they have worn to a new recovery setting (See FIG. 14) a raw coal could be processed that requires the worn geometry.

The only critical part involved in the wear is that it is even and doesn't produce uneven surfaces that will cause turbulence. When this occurs the orifices 64, 64*a*, 74, 84 and 94 must be replaced. The $\theta_9$ included angle and the 0.194B" radius between throat top M and $\theta_9$ produces an even wearing orifice 64, 64*a*, 74, 84 and 94 and at the same time it will maintain the smooth laminar flow required for efficient ash and pyritic sulphur removal.

It is critical that the wear pattern be controlled to maintain the internal geometry of $\theta_9$ included angle and 0.194B" radius between throat top M and $\theta_9$ throughout the useful life of the orifice 64, 64*a*, 74, 84 and 94 to not cause disturbance in the flow pattern so as not to disrupt the centrifugal separation process occurring within the throat of the orifice. A change in the included angle can cause the separation process to raise out of or lower into the throat thus producing a different ash and pyritic sulphur removal efficiency.

(D) Single Outlet and Multi Stage Plant

Set the first stage to recover only high premium coal with some of this coal escaping to the first stage refuse stream and being recovered in the successive stages of washing.

For all around plant performance washing many different types of raw coal feed, the centrifugal separator cyclones proved to have the best operating efficiencies when set at 35% top recovery for very high ash raw coal feeds, e.g. 35% ash and higher, to 65% top recovery when washing very low ash raw coal feeds e.g. 11% to 16% ash. For washing raw coals in between these qualities requires adjustments accordingly.

Reference to FIG. 14 cyclone recovery graph for correct settings when washing different raw coal feeds is made. One will note that this graph gives the vortex finder sleeve diameter and area, the bottom orifice diameter, the raw coal feed % ash, and the cyclone top percent recovery. This graph does not tell you where the plant should operate to produce a certain quality coal. Graphs F.12 ash removal and F.13 Inorganic sulphur removal must be used first to determine what cyclone top percent recovery will be required to produce the quality coal desired. As an example let's suppose we will be seeking a metallurgical coal quality having the following specifications:

Clean Coal

1. % ash 8.0 or less
2. Total % sulphur 1.0 or less
3. and other metallurgical qualities, free swelling index, etc. and the run of the mine raw coal feed has the following specifications:

Raw Coal

1. % ash 14.0 average
2. Total % sulphur 3.0 average
3. % Organic sulphur 0.5 average with the remainder being inorganic sulphurs
4. and other metallurgical qualities, free swelling index, etc.

Plant Settings of an 18 Inch Cyclone

How should the cyclones be set to produce a metallurgical coal? Graph, FIG. 12, ash removal, which was produced over a period of 100,000 tons of coal washed, shows two curves for the first stage settings. One curve is labeled Top Coal and the other Big Joe Coal. The major difference in these two coals is the crushability. The Top Coal crushes very easily to size. The Big Joe Coal is very difficult to crush. It is assumed that, if the Big Joe Coal is crushed to the same size, e.g., $\frac{1}{2}'' \times 0$, as the Top Coal, it will then have the same curve as the Top Coal. Since our example coal can be crushed to the correct size, we use the Top Coal curve. The question now arises as to how much ash removal is required to produce a matallurgical coal, e.g., 7.5% clean coal percent ash. Based upon past experience, a first setting of cyclone top percent recovery is at 60%.

Following the 60% line horizontally to the right until it intersects the first stage Top Coal curve and then following this intersection point vertically down the graph, this line intersects the percent ash removal axis at 68%. Now check to see if this percent recovery and percent ash removal will produce the metallurgical coal desired. Using a two stage centrifugal separator cyclone coal preparation flow chart, the check is made.

Tonnage Targets and Quality Control

When 150 tons are fed to the plant and 60% by weight is recovered in the first stage with 68% of the ash removed, then the first stage produces 90 tons of clean coal yielding a 7.47% ash clean coal. The first stage refuse consists of 60 total tons of which 14.28 tons are ash. This gives a 23.80% ash raw coal feed to the second stage.

The sulphur quality must now be checked. 60% cyclone top percent recovery corresponds to 90% inorganic sulphur removed using F.13 Inorganic Sulphur Removal graph produced over a period of 100,000 Tons of coal washed.

The first stage clean coal sulphur content prediction is:

| | |
|---|---|
| Inorganic sulphur wt. | .37 tons |
| Organic sulphur wt. | .52 tons |
| % Inorganic $S_2$ | 0.41 |
| % Organic $S_2$ | .58 |
| % Total $S_2$ | 0.99 |

The first stage refuse sulphur content prediction is:

| | |
|---|---|
| Inorganic sulphur wt. | 3.38 tons |
| Organic sulphur wt. | .23 tons |
| % Inorganic $S_2$ | 5.63 |
| % Organic $S_2$ | .38 |
| % Total $S_2$ | 6.01 |

First Stage Clean Coal Settings

The first stage clean coal quality prediction meets the metallurgical coal specification so the next step is to set the cyclone dimensions. With the cyclones operating at correct pressures, % solids, and flow velocities, e.g., 23 psi, 19%, 22 FPS, the dimensional settings from F.14 Cyclone Recovery graph to produce 60% cyclone top percent recovery are:

1. Fixed $3\frac{5}{8}''$ bottom orifice diameter with correct dish and orifice geometry.
2. Fixed 14% ash run of the mine raw coal feed.
3. 6" inside diameter vortex finder sleeve is installed.

Second Stage Washing

The next step is to set the second stage to produce metallurgical coal. The feed to the second stage is the refuse from the first stage. The mixing and pumping of the first stage refuse, that occurs between the orifice outlet of the first stage cyclones and the inlet to the second stage cyclones; breakes, washes, and dislodges from the clean coal particles, tightly bonded shales, clays, pyrites and other coal impurities. This accounts for the better separation efficiencies shown on graph F.12 Ash Removal for the second stage both coals curve.

Second Stage Settings

The first stage refuse is predicted to have the following specifications:

| | |
|---|---|
| Prod. Weight | 60TPH |
| Ash Weight | 14.28 Tons |
| % Ash | 23.80% |
| Io $S_2$ Weight | 3.38 Tons |
| % Io $S_2$ | 5.63% |
| O $S_2$ | .23 Tons |
| % O $S_2$ | 0.38% |
| % Total $S_2$ | 6.02 |

We must meet metallurgical coal specification of 7.5% ash so we will look at the % ash first. From experience using F.12 Ash Removal graph 40% recovery will be predicted as correct cyclone top % recovery. This % recovery corresponds to a 87.3% ash removal. The recovered product weight will be 24 TPH containing 1.81 TPH of ash yielding a 7.56% ash clean coal product which is approximately equal to 7.5% ash.

Next the sulphur removal must be considered. The metallurgical specification is 1.0% or less. Using FIG. 12, Inorganic Sulphur Removal Graph as the guide, at a 40% cyclone top percent recovery, this will correspond to 96.7% inorganic sulfur removal. The recovered product will then contain 0.11 TPH inorganic sulfur and 0.11 TPH organic sulfur yielding a 0.46% inorganic sulfur, 0.46% organic sulfur and 0.92% sulfur total. The percent ash and percent sulfur satisfies the specifications for met coal. Thus, the setting which are obtained from FIG. 14, Cyclone Recovery Graph, can be verified in practice.

EXAMPLES

(A) Example 1

Example 1 of Table D, runs 1A through 7A, are plant production runs. The upper Freeport coal is from a strip mine located in Preston County, W. Va. The local striper calls it his Top Coal. The raw coal analysis varies as indicated by the % mineral ash of the feed and the % sulphur content of the feed, Example 1. This coal has a 2 to 4 relative fracturability index, thus the coal breaks apart easily exposing the pyrites and mineral ash to the centrifugal separation. The results are 83% to 90% of the pyritic sulphur being removed and the mineral ash being reduced well below the 8.5% limit with total product recoveries between 82 and 89%.

The fluctuation in % pyritic sulphur being removed depends on the varying fracturability of the coal which is caused by variations in the small binders of hard shales, hard coals and other mineral ashes. If the pyrites are located along the cleavage lines and if the lumps will break apart along these lines then the pyrites become the easiest refuse to separate because of the high (5.02) specific gravity of the pyrites compared to the lower 2.6 and higher specific gravities of the clays, shales, rock and other contaminating minerals.

The fluctuating fracturability is demonstrated by run 7B in Example 2 of Table D. This particular run demonstrates the fracturability index of the coal lowering. The coals in Example 1 and Example 2 came from the same strip pit. Example 1 is called the top coal, and Example 2 called Big Joe which is a thick hard coal seam. Depending on how selective the mining people are they may mix or else the hardness characteristic fluctuates up and down through the two different coal beds and some of the harder coals may get mixed with the softer coals and vice versa.

(B) EXAMPLE 2

Example 2 run 7B was border line coal that had a relative fracturability index of around 5. It barely missed producing met coal but it made excellent steam coal. This coal helps by blending to reduce the total % sulphur of the other steam coals. It is very conceivable that if this coal could have been crushed to $\frac{1}{2}''\times 0$ that the % total sulphur could have fallen below 1.5 and the ash quality meeting met quality. Example 2 clean coal quality meets the present steam coal order of the stripper's and cleaning plant owner's; thus he didn't want to spend more money and lower recoveries to make the coal a better quality. The most important aspect of Example 2 is the ability to clean Big Joe to meet a consumers specification. Before the present plant was installed this hard binder coal had been disregarded because of not being washable in other known methods. Besides its high relative fracturability index it has a large quantity of clay binders and is difficult to wash.

Other cleaning plant personnel stated that Big Joe coal could not be cleaned because the clays would plug the clean coal dewatering screens and the centrifugal dryer basket screens. With the present invention the clays were no problem. The clays broke out of the coal on crushing and easily separated when exposed to the high centrifugal forces. Because of the complete separation of the clays they reported to the refuse and never came in contact with the clean coal dewatering screens and the clean coal centrifugal dryer basket screens.

(C) EXAMPLE 3

Example 3, runs 1C and 2C, is coal from a gob pile located near Georges Creek; Lonaconing, Maryland. The gob pile is believed to be about 100 years old. The gob never underwent spontaneous combustion because of the low sulphur content. This gob will contain a feed around 0.7%. The sulphur content of the clean coal rises, because of only traces of inorganic sulphurs and practically all organic sulfur. This gob separates very easily because of the low present fracturability index of 3 to 5. Before being delivered to the plant the gob is processed through a shaker screen to remove all materials of 2" or bigger top size.

(D) EXAMPLE 4

Example 4, runs 1D and 2D, is a hard binder coal that was separated from the soft good coal, from a strip mine in Somerset County, Pa., by processing the coal through a rotary breaker. The hard binder coal is the refuse from the rotary breaker. This coal has a present fracturability index of 8–9. A stone crusher type crusher is necessary to crush this coal. The feed mineral ash varied between 26% and 35% with a feed sulfur content of 10% to 1.1%. This coal produces an excellent low sulphur steam coal. It was used to blend lower quality coal to meet the steam coal market.

Example 1 represented 7270 tons; Example 2—7040 tons; Example 3—2400 tons; and Example 4—2400 tons of raw coal processed using the invention. To date, the invention has processed approximately 300,000 tons of various types (different present fracturability index) coals successfully.

TABLE D

EXAMPLE 1
Coal Type Metallurgical 2 to 4 LF Index Crush Size ¾ × 0

| Run of 8 Hours | Date | Tons of Washed Coal | % Feed Recovered Dry | $S_2$ Content - Feed % Pyritic Dry | $S_2$ Content - Feed % Organic Dry | $S_2$ Content - Feed % Total Dry | $S_2$ Content Clean Coal % Pyritic Dry | $S_2$ Content Clean Coal % Organic Dry | $S_2$ Content Clean Coal % Total Dry | % Mineral Ash Feed Dry | % Mineral Ash Clean Coal Dry |
|---|---|---|---|---|---|---|---|---|---|---|---|
| 1A | 5/20 | 851 | 81.82 | 1.70 | 0.80 | 2.50 | 0.36 | 0.80 | 1.16 | 14.20 | 7.32 |
| 2A | 5/22 | 878 | 84.44 | 1.16 | 0.80 | 1.96 | 0.26 | 0.80 | 1.06 | 15.00 | 7.48 |
| 3A | 5/30 | 908 | 87.28 | 2.30 | 0.80 | 3.10 | 0.42 | 0.80 | 1.22 | 15.49 | 7.40 |
| 4A | 5/31 | 931 | 89.55 | 2.27 | 0.80 | 3.07 | 0.36 | 0.80 | 1.16 | 15.31 | 7.56 |
| 5A | 6/02 | 855 | 82.21 | 0.96 | 0.80 | 1.76 | 0.12 | 0.80 | 0.92 | 13.39 | 6.32 |
| 6A | 6/03 | 870 | 83.65 | 0.96 | 0.80 | 1.76 | 0.18 | 0.80 | 0.98 | 11.58 | 5.99 |
| 7A | 6/05 | 895 | 86.05 | 0.86 | 0.80 | 1.66 | 0.31 | 0.80 | 1.11 | 14.36 | 8.04 |

LF INDEX IS RELATIVE FRACTURABILITY INDEX OF PRESENT LILLER APPLICATION

EXAMPLE 2
Coal Type Steam 5 to 8 LF Index Crush Size ¾ × 0

| Run of 8 Hours | Date | Tons of Washed Coal | % Feed Recovered Dry | $S_2$ Content - Feed % Pyritic Dry | $S_2$ Content - Feed % Organic Dry | $S_2$ Content - Feed % Total Dry | $S_2$ Content Clean Coal % Pyritic Dry | $S_2$ Content Clean Coal % Organic Dry | $S_2$ Content Clean Coal % Total Dry | % Mineral Ash Feed Dry | % Mineral Ash Clean Coal Dry |
|---|---|---|---|---|---|---|---|---|---|---|---|
| 1B | 5/18 | 756 | 82.21 | 2.17 | 0.80 | 2.97 | 1.13 | 0.80 | 1.93 | 18.31 | 11.30 |
| 2B | 5/19 | 734 | 79.75 | 2.91 | 0.80 | 3.71 | 1.69 | 0.80 | 2.49 | 17.03 | 10.96 |
| 3B | 5/20 | 738 | 80.27 | 1.92 | 0.80 | 2.72 | 1.44 | 0.80 | 2.24 | 15.49 | 9.85 |
| 4B | 5/23 | 704 | 76.49 | 1.84 | 0.80 | 2.64 | 0.96 | 0.80 | 1.76 | 17.16 | 9.90 |
| 5B | 5/24 | 730 | 79.34 | 2.37 | 0.80 | 3.17 | 1.29 | 0.80 | 2.09 | 17.18 | 12.55 |
| 6B | 5/25 | 713 | 77.51 | 2.49 | 0.80 | 3.29 | 1.66 | 0.80 | 2.46 | 20.02 | 12.01 |
| 7B | 6/01 | 646 | 70.17 | 1.50 | 0.80 | 2.30 | 0.46 | 0.80 | 1.26 | 17.85 | 8.59 |
| 8B | 6/01 | 717 | 77.95 | 1.15 | 0.80 | 1.95 | 0.90 | 0.80 | 1.70 | 19.84 | 12.12 |

mineral ash of from 26% to 40% and a sulphur of

EXAMPLE 3
Coal Type Steam 3 to 5 LF Index Crush Size ¾ × 0

| Run of 8 Hours | Date | Tons of Washed Coal | % Feed Recovered Dry | $S_2$ Content - Feed % Pyritic Dry | $S_2$ Content - Feed % Organic Dry | $S_2$ Content - Feed % Total Dry | $S_2$ Content Clean Coal % Pyritic Dry | $S_2$ Content Clean Coal % Organic Dry | $S_2$ Content Clean Coal % Total Dry | % Mineral Ash Feed Dry | % Mineral Ash Clean Coal Dry |
|---|---|---|---|---|---|---|---|---|---|---|---|
| 1C | 9/06 | 713 | 67.04 | Traces | 0.74 | 0.74 | Traces | 0.79 | 0.79 | 25.72 | 11.94 |
| 2C | 9/07 | 688 | 66.21 | Traces | 0.70 | 0.70 | Traces | 0.73 | 0.73 | 26.89 | 11.58 |

EXAMPLE 4

| | | | | Coal Type Steam 8 to 9 LF Index Crush Size ¾ × 0 | | | | | | | |
|---|---|---|---|---|---|---|---|---|---|---|---|
| | | | | $S_2$ Content - Feed | | | $S_2$ Content Clean Coal | | | | |
| Run of 8 Hours | Date | Tons of Washed Coal | % Feed Recovered Dry | % Pyritic Dry | % Organic Dry | % Total Dry | % Pyritic Dry | % Organic Dry | % Total Dry | % Mineral Ash Feed Dry | % Mineral Ash Clean Coal Dry |
| 1D | 9/07 | 643 | 61.87 | 0.21 | 0.85 | 1.01 | 0.10 | 0.85 | 0.95 | 25.81 | 11.24 |
| 2D | 9/08 | 635 | 61.24 | 0.24 | 0.85 | 1.09 | 0.10 | 0.85 | 0.95 | 27.34 | 11.59 |

COALS 1C AND 2C, EXAMPLE 3, DID NOT MEET FREE SWELLING INDEX TO MET COAL

Having thus disclosed the invention, I now claim:

1. A supporting plate adapted for changing the separable dish portion of a centrifugal cyclone, a jigging cyclone or a clarifying cyclone equipped with a vortex finder in combination with a replaceable conical dish having an upper cylindrical edge portion in the cyclone and a lower conical portion including an orifice portion below said plate said cyclone having a flange at its lower end and said plate being bolted thereto; connection at a flange to said cyclone;

said plate having a center hole through which said lower conical portion is inserted from the interior of said cyclone, said center hole being located to support the dish on said plate in alignment with the central axis of said dish and of said cyclone;

said cyclone having an inside cylindrical diameter B;

a plurality of bolt holes disposed about said center hole in said plate for alignment with holes for the bolts in the flange connection to said cyclone;

a plurality of bolts, each with a nut, extending through said bolt holes in said plate;

said upper cylindrical edge portion of dish projecting from said plate into the cylindrical portion of said cyclone of diameter B at a height between about 0.19B to 0.67B;

said plurality of bolts including an elongated fixture bolt threaded at both ends, of a length greater than the height of projection of said upper dish portion to permit a nut on the bottom of said fixture bolt to be loosened and to be slid the full length of the bolt to its bottom threaded end where it may be turned one half to a few turns to provide a stop against which the dish is dropped to rest on the plate and pivoted away from the open cyclone to permit, adjustment of the vortex finder repair, or replacement of parts in the cyclone.

2. The combination of claim 1 wherein said cyclone is a clarifying cyclone and wherein said dish is a long cone constructed in a plurality of sections.

3. The combination of claim 1 wherein said cyclone is a jigging cyclone and said dish is in the form of a cone of equal or lesser height than the height from the inside cylindrical lower end at the top edge of said dish to the inside cylindrical top end of the annular space in the cyclone.

4. The combination of claim 1 wherein said cyclone is a centrifugal separating cyclone and said dish is a unit including an orifice, said dish formed of erosion resistant material.

5. The combination of claim 4 wherein said erosion resistant material is selected from the group consisting of ceramic, refractory carbide alloy, urethane rubber, nickel hardened cast iron and nickel hardened cast steel.

6. The combination of claim 5 wherein said cyclone has a height to diameter ratio of 0.8 to 1.3, preferably 0.90 to 0.95; where the height is measured from the inside cylindrical top end of the annular space to the inside cylindrical bottom end of the cyclone housing adjacent to the bottom support cover plate and the diameter is the inside diameter of said cyclone forming the outside diameter of said annular space.

7. The combination of claim 6 wherein the first included angle formed by the inside conical sides of said dish, measured between said conical sides at the top edge of said dish, is between 80° and 105°, the second included angle below said first included angle and measured in the same manner as said first angle is between 100° and 115° and the area below said second included angle is at the throat of the orifice of the dish.

8. The combination of claim 7 wherein said dish is formed of urethane rubber cured to a Shore A hardness value of about 77 to 85 Durometer.

9. The combination of claim 7 wherein said dish is made of aluminum oxide ceramic.

10. The combination of claim 6 wherein the heavies treated in the cyclone pass out at the bottom of said dish, said dish having an orifice having the smallest inner diameter at its lowermost end at a value of between 0.16B and 0.25B, where B is the diameter of the cyclone bowl, and the entrance to the throat of the orifice has a value of 0.28B to 0.51B.

11. A one piece conical dish-orifice unit formed of an erosion resistant material selected from the group consisting of ceramic, refractory carbide alloy, urethane rubber, nickel hardened cast iron and nickel hardened cast steel for installation into a centrifugal separating cyclone or a jigging cyclone having a height to diameter ratio of 0.8 to 1.3, preferably 0.90 to 0.95, where the height is measured from the inside cylindrical top end of the annular space to the inside cylindrical bottom end of the cyclone housing adjacent to the bottom support cover plate and the diameter is the inside diameter of said cyclone forming the outside diameter of said annular space;

the dish portion of said dish-orifice unit having a height expressed in terms of cyclone bowl diameter B of 0.19B to 0.67B;

the orifice part of said dish-orifice unit having a height of 0.15B to 0.67B;

the first included angle of said dish portion measured at the sides of the dish at the top edge being about 85°±15°;

the second included angle of said dish portion measured at the sides of the dish below said first included angle being 110°±15°, said second angle extending to the radius at the bottom of the dish; and the third included angle being in the orifice and being the included angle between the radius at the bottom of the dish and the smallest inside diameter of said orifice, measured between the conical sides of said orifice and being in the range of 12° with a tolerance of +7° to −3°, these first, second and third angles accelerating removal of heavy particles out of the orifice while avoiding contamination of light fractions leaving the cyclone at the top.

12. A one piece dish and orifice unit as claim in claim 11 wherein said unit is made of cured urethane rubber of Shore A Durometer value lying between 77 and 85.

13. A one piece dish and orifice unit as claimed in claim 11 wherein said unit is made of aluminum oxide ceramic.

14. A one piece dish and orifice unit as claimed in claim 11 wherein said unit is made of a heavy metal carbide refractory alloy.

15. A one piece dish and orifice unit as claimed in claim 11 whrein said unit is made of nickel hardened cast steel.

16. A one piece dish and orifice unit as claimed in claim 11 wherein said unit is made of nickel hardened cast iron.

* * * * *